US009903135B1

(12) United States Patent
Todorov

(10) Patent No.: US 9,903,135 B1
(45) Date of Patent: Feb. 27, 2018

(54) RAINWEAR-SHELTER WITH ATTACHABLE PERIMETERS

(71) Applicant: Mihail Angelov Todorov, Ardmore, PA (US)

(72) Inventor: Mihail Angelov Todorov, Ardmore, PA (US)

( * ) Notice: Subject to any disclaimer, the term of this patent is extended or adjusted under 35 U.S.C. 154(b) by 0 days.

(21) Appl. No.: 15/438,247

(22) Filed: Feb. 21, 2017

Related U.S. Application Data

(63) Continuation-in-part of application No. 14/878,527, filed on Oct. 8, 2015, now Pat. No. 9,631,395.

(60) Provisional application No. 62/096,513, filed on Dec. 23, 2014, provisional application No. 62/073,973, filed on Nov. 1, 2014, provisional application No. 62/061,721, filed on Oct. 9, 2014.

(51) Int. Cl.

| | |
|---|---|
| ***E04H 15/30*** | (2006.01) |
| ***E04H 15/54*** | (2006.01) |
| ***A41D 15/04*** | (2006.01) |
| ***E04H 15/18*** | (2006.01) |

(52) U.S. Cl.
CPC ..... *E04H 15/30* (2013.01); *A41D 15/04* (2013.01); *E04H 15/18* (2013.01); *E04H 15/54* (2013.01)

(58) Field of Classification Search
CPC ..... E04H 15/18; E04H 15/30; E04H 15/54; A41D 15/04
See application file for complete search history.

(56) References Cited

U.S. PATENT DOCUMENTS

| | | | |
|---|---|---|---|
| 535,066 | A | 3/1895 | Mautner |
| 608,351 | A | 8/1898 | Terramore |
| 646,421 | A | 4/1900 | Fisher |
| 703,245 | A | 6/1902 | Faulkner |
| 719,899 | A | 2/1903 | Stacy |
| 766,719 | A | 8/1904 | Mason |
| 901,802 | A | 10/1908 | Gotsche |
| 1,078,992 | A | 11/1913 | Bryan |
| 1,155,800 | A | 1/1914 | Corbet |

(Continued)

FOREIGN PATENT DOCUMENTS

| | | |
|---|---|---|
| BG | 102381 | 11/1999 |
| DE | 29517290 | 12/1995 |

OTHER PUBLICATIONS

Zipper—Wikipedia, pp. 1-6, accessed Sep. 10, 2014.

(Continued)

*Primary Examiner* — Noah Chandler Hawk
(74) *Attorney, Agent, or Firm* — Patents and Licensing LLC; Daniel W Juffernbruch

(57) ABSTRACT

A water-proof fabric has a perimeter consisting essentially of a straight section and a remaining section. The perimeter of the remaining section is circumscribed by first and second zipper tapes arranged in series. The perimeter of the straight section is circumscribed by third and fourth and fifth zipper tapes in series. The fourth zipper tape is located centered around a center of the straight side. The second zipper tape extends along the remaining side to an end of the remaining side. The fifth zipper tape extends along the straight side to the end of the straight side in an orientation to mesh at the corner with the second zipper tape. The fourth zipper tape mates with itself to form a cape. When the first zipper tape mates with itself and the second zipper tape mates with the fifth zipper tape a bivy tent is formed.

20 Claims, 27 Drawing Sheets

(56) References Cited

U.S. PATENT DOCUMENTS

| | | | | |
|---|---|---|---|---|
| 1,193,443 | A | 8/1916 | Swan | |
| 1,198,773 | A | 9/1916 | Robinson | |
| 1,895,911 | A | 10/1931 | Bosson | |
| 2,093,889 | A | 1/1935 | Horn | |
| 2,268,317 | A | 11/1940 | Till | |
| 2,344,379 | A | 3/1944 | Wallin | |
| 2,462,269 | A | 11/1947 | Krempel | |
| 2,659,086 | A | 11/1953 | McGrath | |
| 2,745,105 | A | 5/1956 | Schaefer | |
| 2,971,198 | A | 2/1961 | Tomich | |
| D204,225 | S | 4/1966 | Klein | |
| 3,522,612 | A | 8/1970 | Palmer | |
| 3,545,461 | A | 12/1970 | Carlson | |
| 3,584,315 | A | 6/1971 | Hardy | |
| 3,699,986 | A | 10/1972 | Kirkham | |
| 3,837,006 | A | 9/1974 | Laseman | |
| 3,874,396 | A | 4/1975 | Kirkham | |
| 4,180,867 | A | 1/1980 | Ridgeway | |
| 4,370,755 | A | 2/1983 | Crumby | |
| 4,484,362 | A | 11/1984 | Asher | |
| 4,594,735 | A | 6/1986 | Rolf | |
| 4,598,725 | A | 6/1986 | Brewer | |
| 4,703,521 | A | 11/1987 | Asher | |
| 4,752,971 | A | 6/1988 | Meserol | |
| 4,862,906 | A | 9/1989 | Jordon | |
| 5,217,034 | A | 6/1993 | Yih et al. | |
| 5,278,998 | A * | 1/1994 | Book | A41D 13/0012 190/1 |
| 5,394,897 | A | 9/1995 | Ritchey | |
| 5,769,106 | A * | 6/1998 | Achuff | A41D 15/04 135/95 |
| 5,924,132 | A | 7/1999 | Wigutow | |
| 6,243,873 | B1 | 6/2001 | Aliff | |
| 6,275,993 | B1 | 8/2001 | McCarley | |
| 6,341,379 | B1 * | 1/2002 | Kokus | A41D 15/04 135/95 |
| 6,351,851 | B1 | 3/2002 | Yardan | |
| 6,353,933 | B1 | 3/2002 | Love | |
| 6,357,462 | B1 | 3/2002 | Laosunthara | |
| 6,370,692 | B1 | 4/2002 | Dyun et al. | |
| 6,565,139 | B2 | 5/2003 | Bayerle | |
| 6,698,029 | B2 * | 3/2004 | Tadros | A41D 1/08 2/227 |
| 6,742,533 | B2 | 6/2004 | Olson | |
| 6,782,905 | B2 | 8/2004 | Chu | |
| 7,137,660 | B2 | 11/2006 | Weddington | |
| 7,316,238 | B2 | 1/2008 | Sumner | |
| 7,673,642 | B1 | 3/2010 | Shires | |
| 7,765,611 | B2 | 8/2010 | Marshall et al. | |
| 7,832,032 | B2 * | 11/2010 | Haislip | A41D 15/04 2/69 |
| 7,908,676 | B2 | 3/2011 | Gutshe | |
| 8,453,664 | B2 | 6/2013 | Parsons | |
| 8,510,865 | B2 | 8/2013 | Pyfer et al. | |
| 9,103,137 | B2 | 8/2015 | Williams | |
| 9,185,940 | B2 * | 11/2015 | Sparks | A41D 15/04 |
| 9,763,485 | B1 * | 9/2017 | Weitala | A41D 15/04 |
| 2002/0134415 | A1 | 9/2002 | Boulange | |
| 2009/0034882 | A1 * | 2/2009 | Chih | A41D 13/0012 383/2 |
| 2009/0070913 | A1 | 3/2009 | Park | |
| 2009/0094728 | A1 | 4/2009 | Boyle | |
| 2009/0249528 | A1 | 10/2009 | Su | |
| 2011/0179548 | A1 | 7/2011 | Weston | |
| 2011/0258749 | A1 * | 10/2011 | Hibbs | A41D 3/08 2/84 |
| 2013/0042383 | A1 | 2/2013 | Ryan | |

OTHER PUBLICATIONS

YKK Quality Zipper Supply Catalog, www.qualityzipper.com, 1-800-245-9515, pp. 1-16, 2013.

YKK Fastening Creation, Catalog, YKK India PVT, Ltd., Fastening Products Group, pp. 1-16, 2006.

English Translation of Bulgarian OG Publication BG102381 by Mihail Angelov Todorov (Same as foreign patent document 1 above) OG published Nov. 31, 1999.

Bulgarian OG Publication BG102381 by Mihail Angelov Todorov (Same as foreign patent document 1 above) OG published Nov. 31, 1999.

Bulgarian BG102381 Drawings by Mihail Angelov Todorov (Same as foreign patent document 1 above) OG published Nov. 31, 1999.

English Translation of Bulgarian BG102381 Specification by Mihail Angelov Todorov (Same as foreign patent document 1 above) OG published Nov. 31, 1999.

Bulgarian BG102381 Specification by Mihail Angelov Todorov (Same as foreign patent document 1 above) OG published Nov. 31, 1999.

* cited by examiner

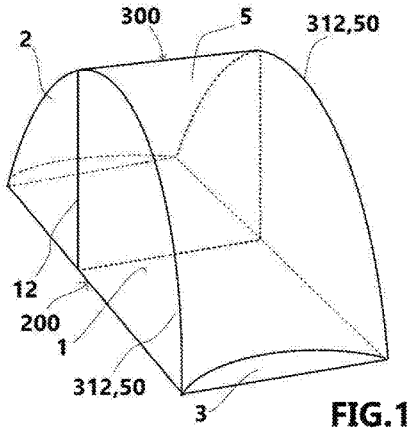
FIG.1
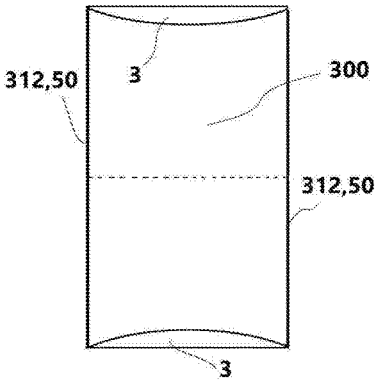
FIG.2
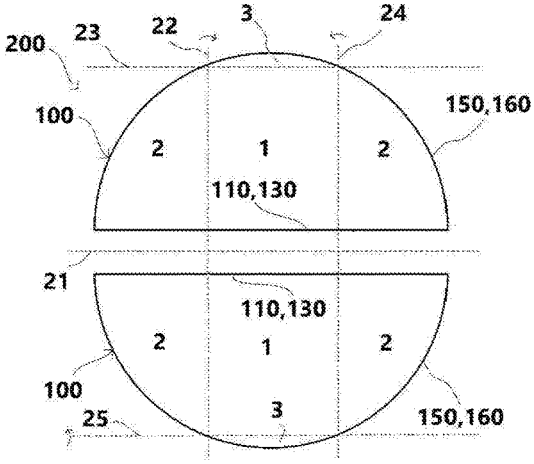
FIG.3
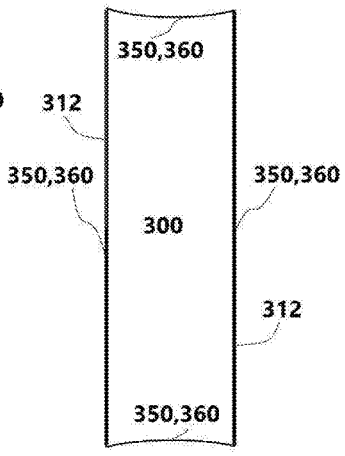
FIG.4
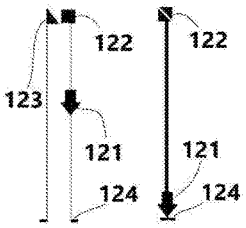
FIG.5
FIG.6
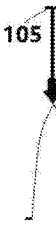
FIG.7
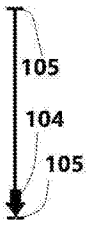
FIG.8
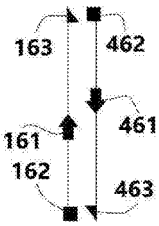
FIG.9
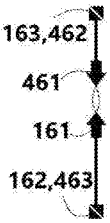
FIG.10

| EMBODIMENTS / MAIN SYSTEM COMPONENTS | BOTTOM FABRIC | | SUPPORT | | UPPER FABRIC | | | | | |
|---|---|---|---|---|---|---|---|---|---|---|
| | SEMI-CIRCLED FIG.12 | CIRCLED FIG.18 | POLE FIG.23 | SEGMENT FIG.20 | HOOP TENT CANOPY FIG.4 | TWO PERSONS CANOPY FIG.25 | THREE PERSONS CANOPY FIG.29 | FOUR PERSONS CANOPY FIG.33 | FIVE PERSONS CANOPY FIG.37 | ONE PERSON CANOPY FIG.41 |
| HOOP TENT FIG.1 | 2 OR | 1 | 2 | | 1 | | | | | |
| TWO PERSONS DOME TENT FIG.27 | 2 OR | 1 | 3 | | | 1 | | | | |
| THREE PERSONS DOME TENT FIG.31 | 2 OR | 1 | 2 AND | 2 | | | 1 | | | |
| FOUR PERSONS DOME TENT FIG.35 | 2 OR | 1 | 2 AND | 2 | | | | 1 | | |
| FIVE PERSONS DOME TENT FIG.39 | 2 OR | 1 | 3 AND | 3 | | | | | 1 | |
| ONE PERSON DOME TENT FIG.43 | 1 | | 2 | | | | | | | 1 |
| CAPE TENT FIG.49 | 1 | | | | | | | | | |

FIG.11

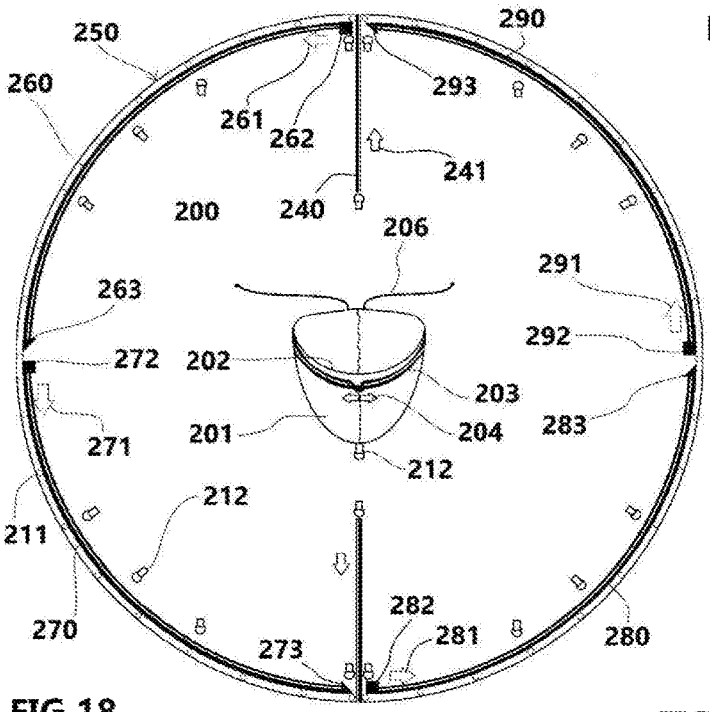
FIG.18
FIG.20
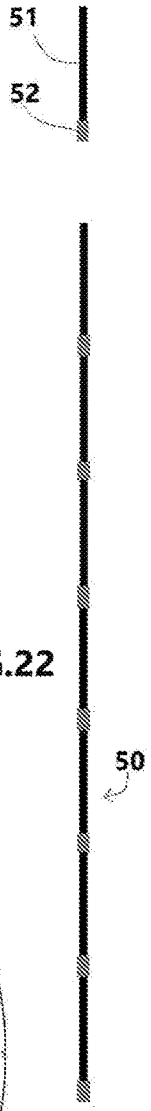
FIG.22
FIG.21
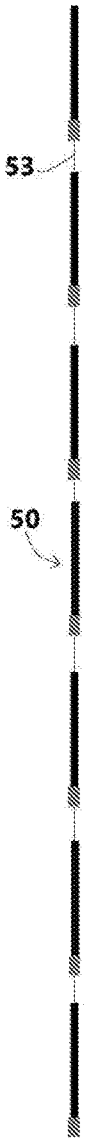
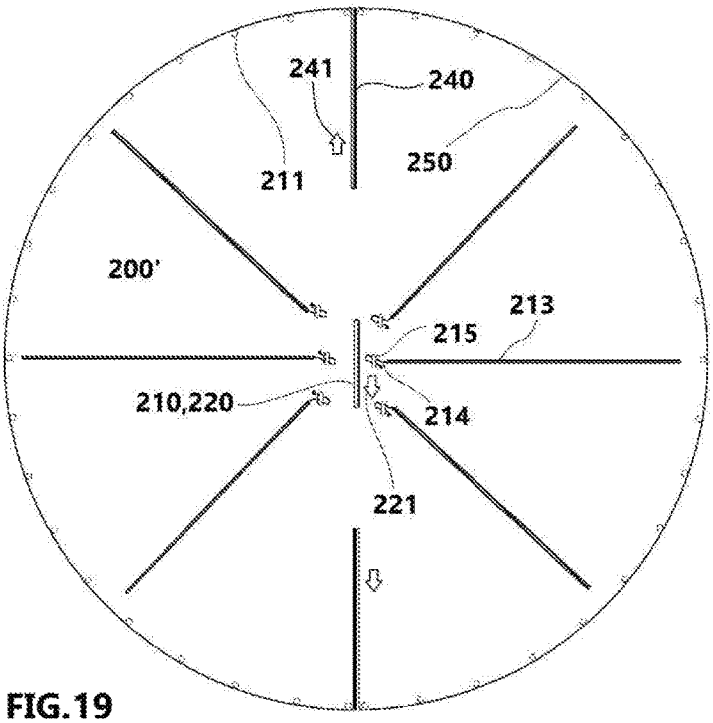
FIG.19
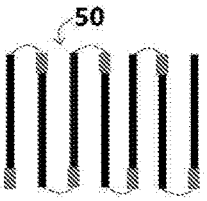
FIG.23

FIG.36
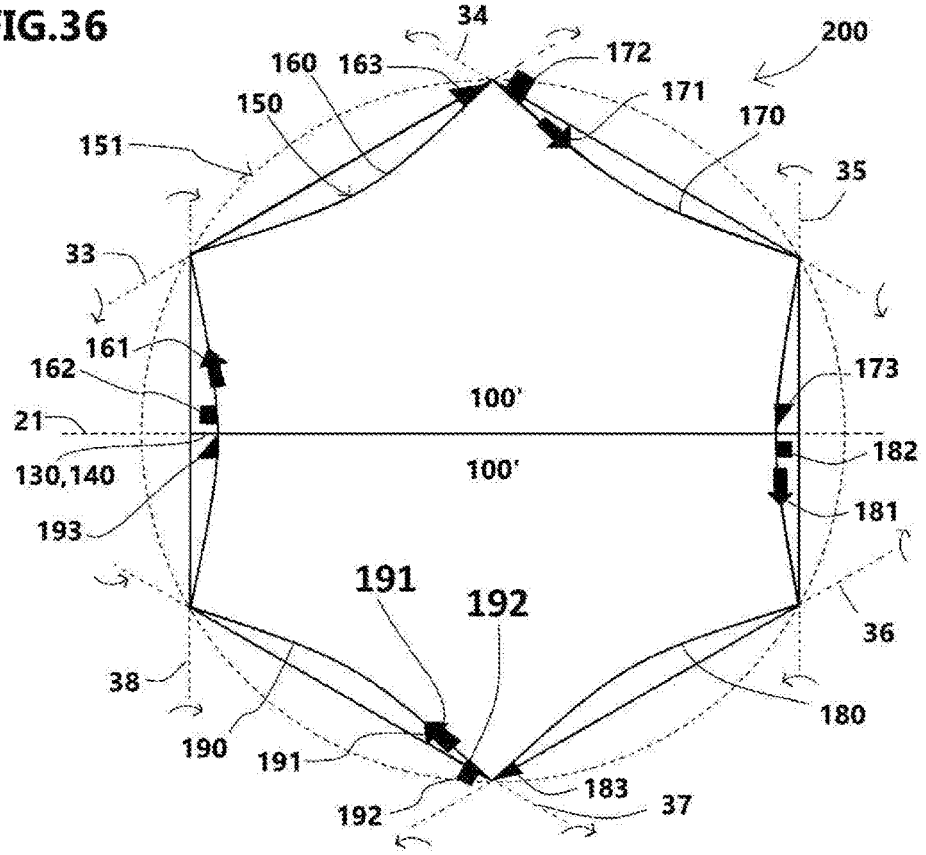
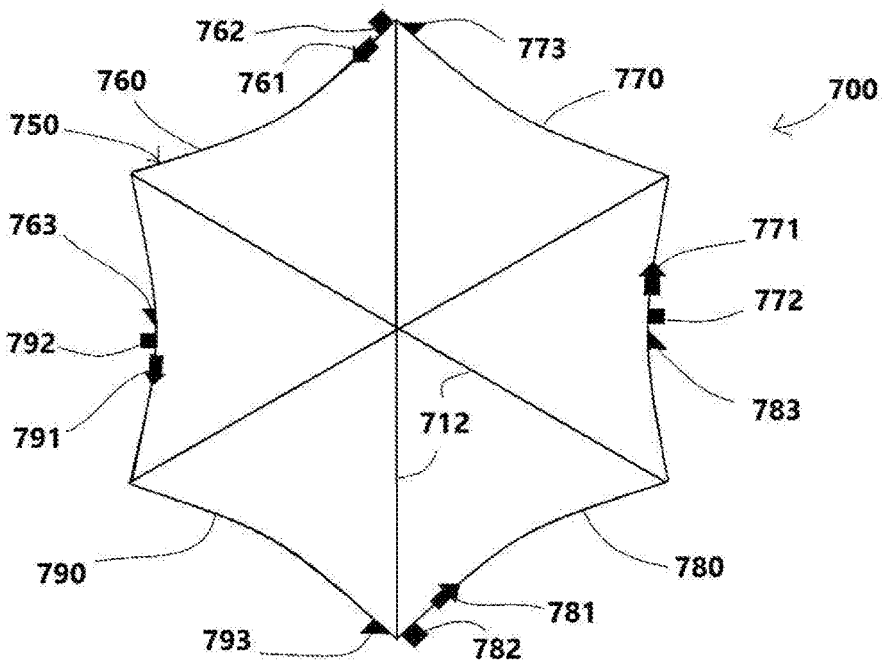
FIG.37

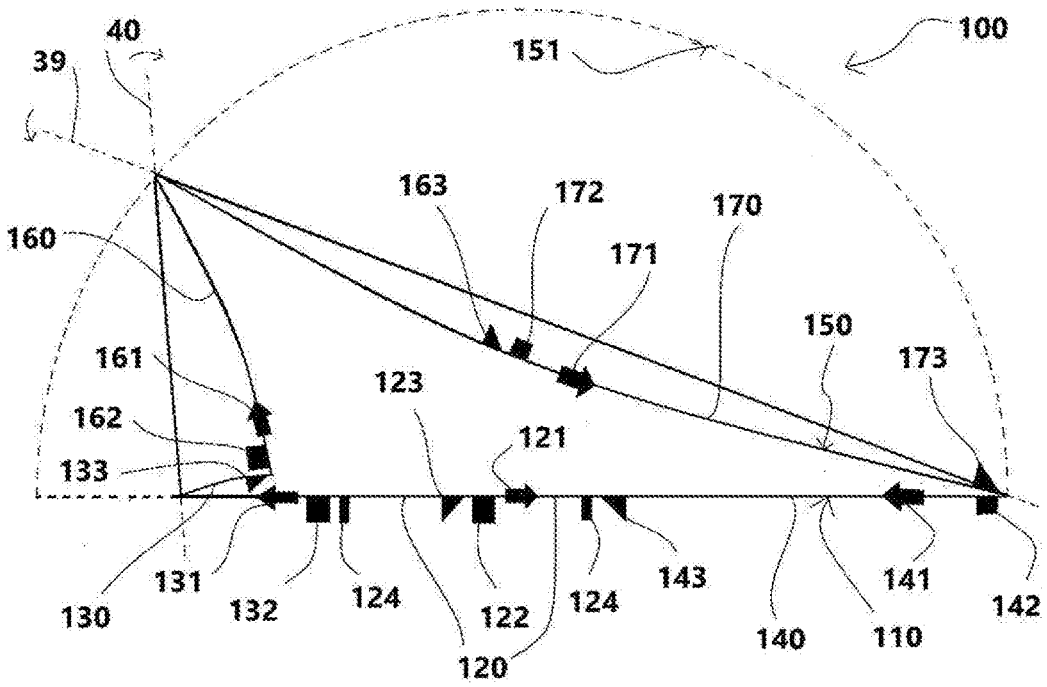
FIG.40
FIG.41
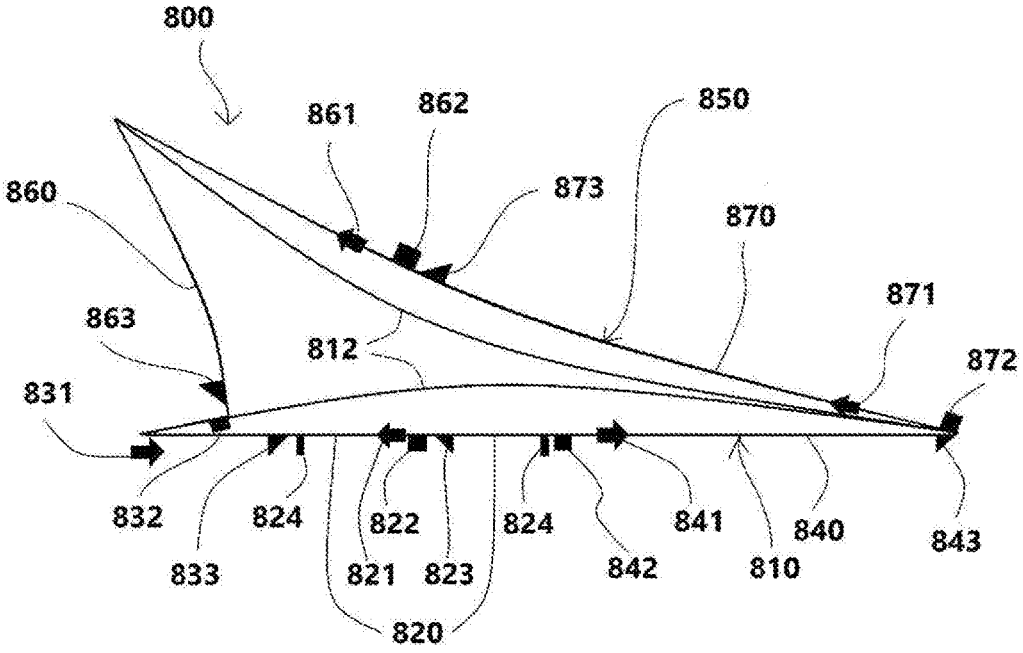

FIG.42
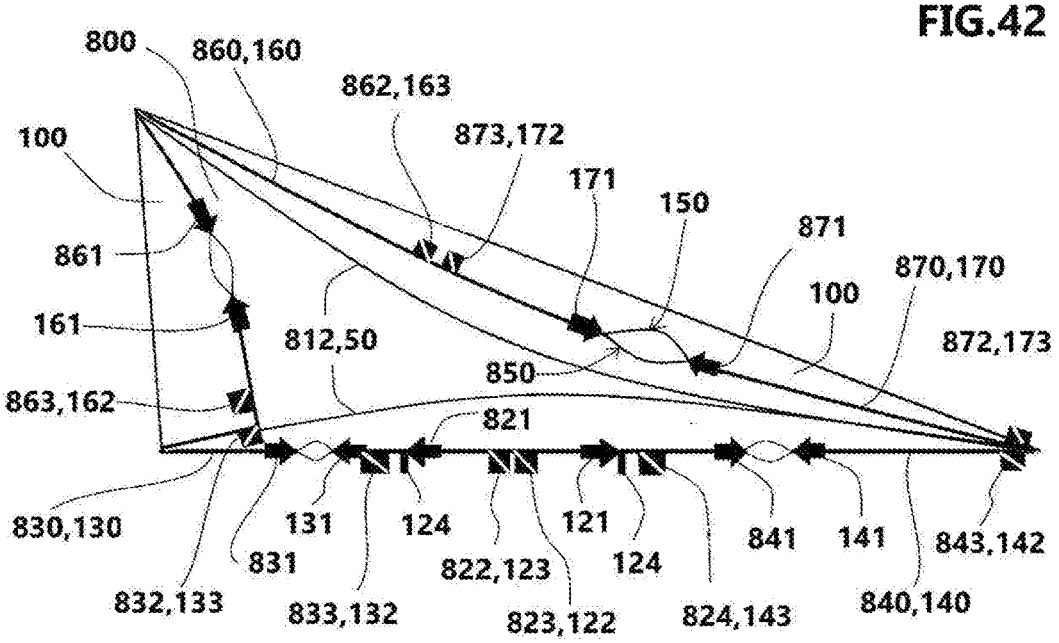
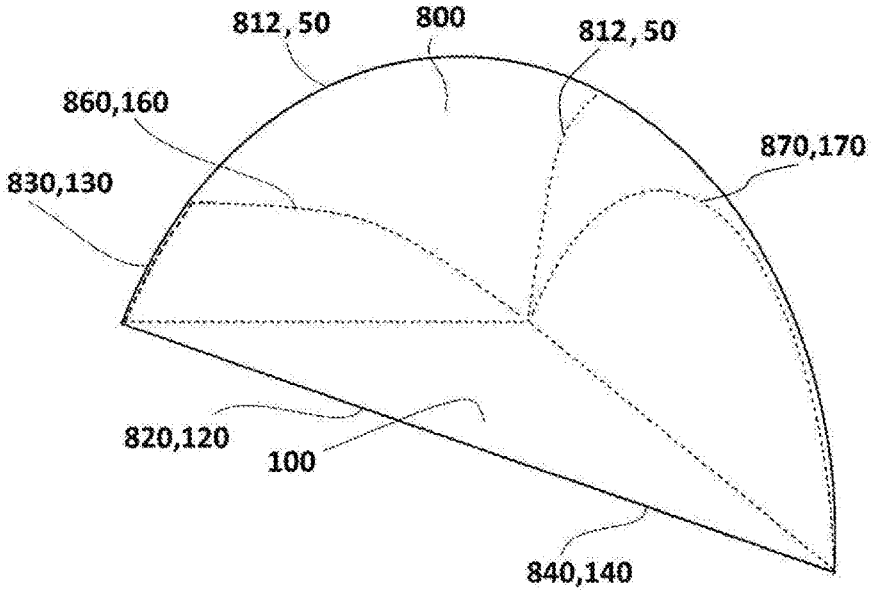
FIG.43

| Embodiment | Figures | Tent description | Mating zipper equivalances to form a tent | Garment description | Mating zipper equivalances to form a garment |
|---|---|---|---|---|---|
| bivy tent | FIGS.68-78 | The semi-circled floor is folded and opposing perimeters are connected with zippers 160, 170, 130, 140, 120 | 120+130=160,170=170,140=140 or 120+140=170,160=160,130=130 | cape | 120=120 130=140 optional |
| bivy tent | FIG.81 | The multiangular floor is folded and opposing perimeters are connected with zippers 160, 170, 130, 140, 120. | 120+130=160,170=170,140=140 or 120+140=170,160=160,130=130 | cape | 120=120 130=140 optional |
| bivy tent | FIGS.82-84 | The triangular floor is folded and opposing perimeters are connected with zipperers 1060',1070',1040',1060",1070",1040" | 1060'=1060", 1040"=1040" 1070"=1070" | cape | 1020'=1020" |
| bivy tent | FIGS.12-13 | The semi-circled floor is folded and opposing perimeters are connected with zippers 160, 170, 130, 140, 120. | 130=160, 170=170, 140=140 or 140=170, 160=160, 130=130 | cape | 130=140 |
| cape tent or blind | FIG.49 | The semi-circled floor is folded in half with zippers 160, 170, 130, 140, 120 | 120=120, 130=140 needed for tent 130=140 optional for blind, 160=170 optional | cape | 130=140 |
| single person pyramidal tent | FIGS.61-64 | The semi-circled top is folded to pyramid with zippers 160, 170, 130, 140, 120. They connect to trapezoid floor with zippers 960 and 970. | 120=120, 130=140, 160=960, 170=970 | cape | 130=140 |
| two person dome tent | FIGS.24-27 | The circled floor is folded to form triangle with zippers 160, 170, 180, 190. They connect to triangular canopy with zippers 460, 470, 480,490. | 160=460, 170=470, 180=480, 190=490 | two capes or one poncho | 130=140, mating zippers not needed for poncho |
| three person dome tent | FIG.28-31 | The circled floor is folded to form rectangle with zippers 160, 170, 180, 190. They connect to rectangular canopy with zippers 560,570,580,590. | 160=560, 170=570, 180=580, 190=590 | two capes or one poncho | 130=140, mating zippers not needed for poncho |
| four person dome tent | FIGS.32-35 | The circled floor is folded to form square with zippers 160, 170, 180, 190. They connect to square canopy with zippers 660, 670, 680, 690. | 160=660, 170=670, 180=680, 190=690 | two capes or one poncho | 130=140, mating zippers not needed for poncho |
| five person dome tent | FIG.36-39 | The circled floor is folded to form hexagon with zippers 160, 170, 180, 190. They connect to hexagonal canopy with zippers 760,770,780,790. | 160=760, 170=770, 180=780, 190=790 | two capes or one poncho | 130=140, mating zippers not needed for poncho |
| one person dome tent | FIGS.40-43 | The semi-circleed floor is folded to form triangle with zippers 160, 170, 180, 190, 120. They connect to triangular canopy with zippers 860, 870, 880, 890, 820 | 160=860, 170=870, 180=880, 190=890, 120=820 | cape | 130=140 |
| semi-circle sub-assemblies | FIGS.12-17 or FIGS.68,75-78 | Two semi-circles forming circle for floor. | 130'=140", 120'=120", 140'=130" | n/a | |

FIG.85

RAINWEAR-SHELTER WITH ATTACHABLE PERIMETERS

BACKGROUND OF THE INVENTIONS

1. Technical Field

The present inventions relate to rainwear, capes, tents, shelters and other outdoor devices, and, more particularly, relate to rainwear convertible into a bivy sack like shelter.

2. Description of the Related Art

Tents and other temporary shelters are used since prehistoric times in a number of outdoor activities.

Generally, for protection from the elements, a tent could be used in only one way—by setting up the one shelter it is designed for. This is the reason the tent is not an item of the everyday life. On average, it is used few days per year, and sometimes, not every year.

Sometimes on a solo backpacking expedition, where the gear weight is a critical feature, it happens so that a person has to take with him, or her, the three person family tent, which he or she already owns. One way to avoid carrying extra weight would be the buying of yet another non-basic, single function product—the lighter single person tent.

On the other hand, people use other, somehow related, products such as jackets, umbrellas, bicycle/moped covers, which serve functions related to the tent's function—protection from the elements. All these, including the tents themselves, are examples of non-basic, specialized, one-function products.

Many inventions attempt to close this gap of ineffectiveness by the combination of two functions into a single, but more complex product.

During outdoor activities like hiking, people carry along garments, tents and other to keep them dry in case of rain. Since these articles may not be needed simultaneously, it makes sense to save bulk and weight by combining them and their functions into one, multifunctional item.

A rainwear-tent must be lightweight and use minimum fabric, but still provide sufficient volume around its user's arm and shoulders. To provide waterproofness, it must have minimum piercing of the fabric. It must also have simple construction and be easy to operate.

Attempts to combine rain gear and tents date way back in time and the most widely used design is a rectangular rain poncho tarp with an opening near the middle for the head to pass through. To create a shelter, one or two of these ponchos are connected and pitched in an A-shaped tent, e.g. Swan in U.S. Pat. No. 1,193,443. This design, and the many others like it, is not frame supported and is unstable in the wind.

Asher's U.S. Pat. No. 4,703,521 design is frame supported, thus wind resistant, but it does not provide a floor.

Because a tent floor is of no less importance than a tent ceiling, the tent must also provide a completely enclosed compartment, including a floor.

Yih et al in U.S. Pat. No. 5,217,034 uses the basic, rectangular rain poncho as the top of a bivouac sack. Essentially, the bivy provides the floor of the tent, while the poncho provides the ceiling. This construction does not provide the options for choosing insulation according to the season, which a typical tent-sleeping bag combination would give, unless the user has multiple bases and tops at hand.

The shelter-tent design should be kept simple and the mattress and sleeping bag functions should be outsourced to other camping gear.

Asher et al in U.S. Pat. No. 4,484,362 provides tent floor by folding and zipping the opposing edges of the fabric, thus wrapping it around the user's sleeping bag. The poncho design requires cuttings in the fabric for the head, thus compromising the water resistance. Other designs have cutting in the fabric not only for the head, but for the hands too, e.g. Stacy in U.S. Pat. No. 719,899.

Even piercings in the middle of the fabric, like Achuff in U.S. Pat. No. 5,769,106, could and should be avoided.

Instead a poncho, a cape-like piece of fabric, with designated areas at the periphery for the head and limbs, would avoid the need for cutting in the fabric. McGrath in U.S. Pat. No. 2,659,086 suggests a design which, although has cuts in the fabric for openings for the hands, is essentially a cape, usable as a shelter, which completely encloses the user's body. The design requires size adjustment since the length of the rainwear is longer than the user's height. When the user walks, the extra-long part is folded and attached, which requires piercing. In this design the shelter and the raincoat utilizations are in the same line or direction.

The already mentioned Asher et al in U.S. Pat. No. 4,484,362 eliminates the need for size adjustment. When his design is used as a poncho, its length is cut in halve, while when used as a poach-like type of shelter, the full length of the fabric is used, but because it is a poncho, as discussed above, it has a cut in the fabric for the head.

A theoretical shape could be derived from the two previous—a similar one to Till in U.S. Pat. No. 2,268,317. This is a polygonal shape, with one longer and one shorter dimensions. The shorter side would facilitate the cape use, not reaching the ground, and having no cuttings or piercing in the fabric what so ever. The device is then turned 90 degrees, or to its longer side, when constructing a shelter. This design, however, does not wrap around user's sleeping bag, thus does not provide a floor and it has excess of fabric at unnecessary places.

Kokus in U.S. Pat. No. 6,341,379 teaches about a squared hooded piece of fabric, with zippers at its diagonal with hood in the middle of it. When folded at this diagonal, this piece of fabric forms a triangular poncho. Theoretically, when turned 90 degrees this shape could be used to be wrapped around user's sleeping bag but the design does not provide for it since there are no ways to connect the periphery around the hood with other parts of the periphery.

All these are examples of proposals for products with one or few functions, but which still fail to address a vast majority of outdoor needs. Of course, there are always tradeoffs and probably there will never be discovered a device which could solve all outdoor issues.

Todorov in a Bulgarian patent application filed on Apr. 10, 1998 and published in the Official Gazette of the Patent Office of the Republic of Bulgaria as BG 102381A on Nov. 30, 1999, showed a circularly shaped rain poncho, which when folded symmetrically, constructs a shelter by closing opposing zippers at its periphery. The construction does provide a floor, but uses too much fabric, which adds weight.

A modular, truly versatile shelter system, which has more than one generic item, would better adjust to the user's needs.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein:

FIG. 1 illustrates a perspective view of a hoop type enclosed compartment according to one embodiment of the present inventions;

FIG. 2 illustrates a top view of the hoop type enclosed compartment according to one embodiment of the present inventions;

FIG. 3 illustrates a flat view of two semi-circled bottom fabrics for the hoop type enclosed compartment, according to one embodiment of the present inventions;

FIG. 4 illustrates a flat view of an upper piece making up the tent canopy, namely the ceiling and parts of walls—of the hoop type enclosed compartment according to one embodiment of the present inventions;

FIG. 5 and FIG. 6 illustrates diagrams of examples of an open-end type zipper, in both an open positon and a closed positon according to embodiments of the present inventions;

FIG. 7 and FIG. 8 illustrates diagrams of an example of a closed-end type zipper, in both an open positon and a closed positon; according to embodiments of the present inventions;

FIG. 9 and FIG. 10 illustrates diagrams of an example of a pair of single-tape type zippers, in both an unattached, open positon for the pair and attached in a nearly closed positon for the pair according to embodiments of the present inventions;

FIG. 11 illustrates in a table demonstrating the correspondence of compatible component parts making up the combinations of various embodiments;

FIG. 18 and FIG. 19 illustrate respective top and bottom views of the outside surface of one preformed circled bottom piece according to embodiments of the present inventions;

FIG. 20-23 illustrates a side view of basic elements of exemplary a tent poles, assembled and disassembled, according to embodiments of the present inventions;

FIG. 36 illustrates a top view of the inside surface of a circled bottom fabric, or two connected semi-circled bottom fabrics, lied down on the ground and folded in order to provide a hexagonal five person tent floor and parts of tent walls, according to embodiments of the present inventions;

FIG. 37 illustrates a top view of an upper fabric with a three dimensional special shape, designed to serve as a canopy and provide the five person volume over the hexagonal tent floor according to embodiments of the present inventions;

FIG. 40 illustrates a top view of the inside surface of a semi-circled fabric, lied down on the ground and folded in order to provide a triangular single person tent floor and parts of tent walls, according to embodiments of the present inventions;

FIG. 41 illustrates a top view of an upper fabric with a three dimensional special shape, designed to serve as a canopy and provide the single person volume over the triangular tent floor according to embodiments of the present inventions;

FIG. 42 illustrates a top view of the newly formed tent—a combination of the canopy, made by the upper fabric from FIG. 41, situated on top of the tent floor and parts of walls, made by the bottom fabric from FIG. 40, according to embodiments of the present inventions;

FIG. 43 illustrates is a view in perspective of the newly formed tent according to embodiments of the present inventions;

FIG. 85 illustrates in a table a summary of embodiments of the present inventions.

DETAILED DESCRIPTION OF THE PREFERRED EMBODIMENTS

Figure 13:
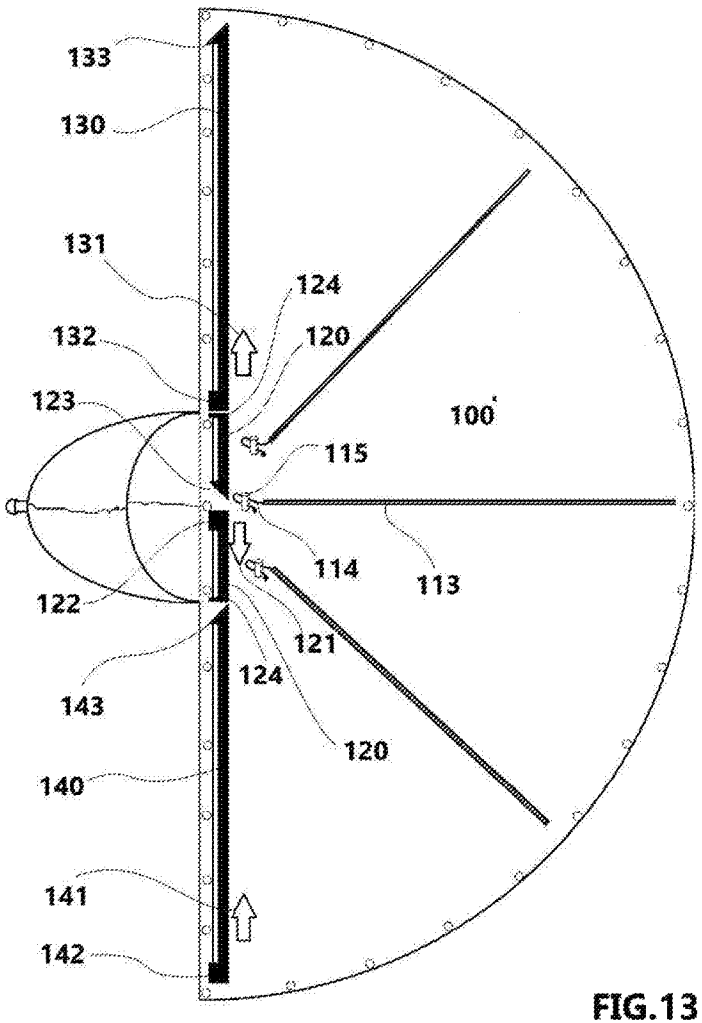
FIG. 12 and FIG. 13 illustrate respective top and bottom views of the outside surface of a semi-circled bottom piece according to embodiments of the present inventions.

The embodiments of the present inventions disclosed herein relate to tents and other outdoor gear. The embodiments represent various systems with many of the same elements a typical tent could have. These elements, however, are regarded as separate items, not components of a bigger structure. What combines them is compatibility. That means that they could be used together, independently or in partial combinations for many different uses such as hammock covers, fisherman/hunter blinds, and numerous kinds of tents, bicycle/rider covers, raincoats, and cushions.

Typical tent components contain multiple elements such as footprint, enclosed floor-canopy compartment, fly, poles, stakes, and guy lines. Aspects of the outdoor shelter in embodiments herein is the enclosed compartment—the canopy and the tub floor—to keep occupants dry and sheltered from wind and insects and promote some privacy.

A bivy sack tent can be formed by wrapping a semi-circled cape, instead of a poncho, around a user's sleeping bag. This bivy sack tent is formed with the radius of the semi-circled cape from the neck to the ground. Thus a cape can be used as both a raincoat garment and also a sleeping shelter, without any increased weight by carrying multiple items.

FIG. 1 illustrates a perspective view and FIG. 2 illustrates a top view of a hoop type enclosed compartment according to one embodiment of the present inventions. The lower part of the tent, made out of a bottom water-proof fabric 200 is called tent bottom and includes a floor 1, walls 2 with doors 12 and parts of walls 3. On top of it, made out of an upper fabric 300, is the tent canopy 5, which includes the tent ceiling and parts of the walls. The upper fabric could also be water-proof, when the tent is designed to be without a water-proof tent fly. The bottom water-proof fabric 200 and the upper fabric 300 are designed as separable units in order to provide the user with more functionality. For example, the bottom fabric 200 can also be used as a poncho alone, to be worn by the user, provided that it has a hood attached, while the upper fabric 300, in combination with supporting poles 50 which run through sleeves 312, could be used as a beach tent where no water-proof bottom is needed.

The sleeves 312 are an accommodation for tent support poles in this one and other embodiments. The sleeves 312 are preferably sewn into the upper fabric 300 according to this one embodiment. Alternatively the sleeves 312 can be substituted for hooks, loops or channels in other embodiments.

The perimeter of the bottom water-proof fabric in embodiments is any ellipse or, in some embodiments specifically, a circle. In other embodiments the perimeter of the bottom water-proof fabric in embodiments is a polygon or, in some embodiments specifically, a parallelogram or, in some further embodiments specifically, a rectangle or a square. Although the separation of the tent enclosed compartment could be done in any possible way, choosing a shape for the bottom fabric such as an oval, arch or other rounded sides shape, would provide great possibilities for variation in the floor footprint, which would help to address variety of outdoor needs.

Of all the rounded-side shapes, the circle has superiority, since the bottom fabric is meant to be worn as cape or poncho, and a circled shape with a radius the distance between the neck and ankles of an average height user would provide the biggest tent floor surface, without the need for size adjustment, when used as poncho.

Furthermore, the separation of the circled bottom fabric into two semi-circles would turn the poncho into two capes, serving two persons, which also decreases the equipment weight per person factor. The separation also adds other useful features, like tent doors 12.

FIG. 3 illustrates a flat view of two semi-circled bottom fabrics 100 connecting at line 21 parts of their perimeters 110, through zipper 130, into a circled bottom fabric 200, thus making up the hoop type enclosed compartment according to one embodiment of the present inventions. Next, the resulting bottom fabric 200 is folded at lines 22, 23, 24 and 25, forming tent floor 1, walls 2 and part of walls 3. The bottom fabric has zipper 160, circumscribing the curved part of its perimeter 150. Zipper 160 mate with corresponding zipper 360, circumscribing perimeter 350 of the upper fabric 300, which are visible on FIG. 4

FIG. 4 illustrates a flat view of the upper fabric 300 making up the hoop type enclosed compartment according to one embodiment of the present inventions. The upper fabric 300 could be made out of water-proof fabric or a bug-screen fabric or combinations with perimeter close to a rectangle, where the two small sides are lightly curved. Sleeves 312, along the longer sides, are formed to accommodate tent poles, which will support the structure.

The zippers 130 which connect the two semi-circled bottom fabrics 100 into a single bottom fabric 200 must be compatible in terms of length and ability to mate. The zippers 160 and 360 which connect the bottom fabric 200 with the upper fabric 300 must be compatible in terms of length and ability to mate. They include slider with Y-shaped channel inside, which guide and connect two tapes of zipper elements.

The zippers in the embodiments of the present inventions are defined as having a pair of zipper tapes joined by a slider. The slider slides along the pair of zipper tapes to join the zipper tapes. Each of the pair of zipper tapes preferably has a series of zipper elements, or teeth, for joining to the other zipper tape. This joining by the zipper should be secure and holds the pressure forces of hazards such as a strong wind or an object such as a human foot kicking the lower perimeter of the outdoor structure. While each of the pair of zipper tapes preferably have a series of elements, or teeth, for joining to the other zipper tape, the zipper tapes can omit the teeth assuming a substitute for joining to mating zipper tape joins with enough ultimate tensile and shear strength to hold under such hazards.

FIG. 5 and FIG. 6 illustrate diagrams of examples of an open-end type zipper, in both an open positon and a closed positon. It can have two tapes, with attached elements, separable on both ends. To close together the two tapes of the zipper, first, insert pin 123, or simply "pin", illustrated by a triangle symbol, is inserted into, the symbolized by a square, receptacle box 122, or simply "box", through the slider 121, which is symbolized by an arrow. Last, the slider is pulled into direction of the zipper stop 124, illustrated by a rectangle symbol. The slider has a Y-shaped channel within, which guides and connects together the zipper tapes with elements on them.

FIG. 7 and FIG. 8 illustrate diagrams of an example of a closed-end type zipper, in both a semi-opened positon and a closed positon. In FIG. 7 a pull 104 on the closed-end type zipper is partially slid between zipper stops 105. It has two tapes with attached elements and is permanently connected on one end at one zipper stop 105. The zipper is closed by pulling the slider to the other end, where it is stopped by the zipper stop 105 as shown in FIG. 8. The slider has a Y-shaped channel within, which guides and connects together the zipper tapes with elements on them.

FIG. 9 and FIG. 10 illustrate diagrams of an example of a pair of single-tape type zippers, in both an unattached, open positon for the pair illustrated in FIG. 9 and attached in a nearly closed positon for the pair illustrated in FIG. 10. Each single-tape type zipper has one fabric tape with attached elements, with a receptacle box 162, 462 on one end, an insert pin 163, 463 on the other end, and slider 161, 461 in between. What is peculiar about this zipper is that one such zipper could form connection with another identical one. Pin 163 is inserted into box 462 through slider 461. Pin 463 is inserted into box 162 through slider 161. Sliders 161 and 461 have Y-shaped channels within, which guide and connect together the zipper tapes with elements on them. This kind of zipper is also known as a "loop zipper", since it is able to connect its pin 163 (463) to its own box 162 (462), through its slider 161 (461) and close itself to the middle, thus forming a loop. In the proposed invention, plastic molded zippers are a good choice for the single-tape and open-end zippers, while the closed end could be of any kind.

The bottom fabric, in its circled and semi-circled variation, together with tent poles, extendable with individual tent pole segments, could be combined into an outdoor system. Different form and size upper fabrics could be designed for canopies and added to that system, in order to address a number of outdoor needs, like shelter size adjustment according to the number of users, styles of camping, camping equipment weight distribution between the users. One such system would allow the user to upgrade to tents with bigger dimensions reusing most of the previous configuration components, or replace damaged modules, easily and at low cost since not the whole enclosed compartment needs to be replaced. This would save money for the end user in the long run, while simultaneously providing increased functionality.

FIG. 11 illustrates in a table demonstrating the correspondence of compatible component parts making up the combinations of various embodiments. Additional to the component parts shown in the table of FIG. 11 are ancillary components such as guy lines, stakes, floor footprints, and flies. These components are omitted from the table of FIG. 11 for simplicity.

Each row in the table of FIG. 11 corresponds to the combinations of various embodiments.

The first column in the table of FIG. 11 illustrates a description, exemplary figure number and icon for each of these various embodiments.

The first row in the table of FIG. 11 illustrates a description, exemplary figure number and icon for each of the various main system components.

The second column in the table of FIG. 11 illustrates the semi-circled and circled bottom fabrics used to form bottom part of the tent. They use single-tape zippers to interconnect with the upper fabrics.

The third column in the table of FIG. 11 illustrates prefabricated poles, constructed from standard size pole segments connected with a bungee. Further, for construction of bigger tents, the length of these poles could be extended by attaching additional pole segments.

The fourth through the ninth columns in the table of FIG. 11 illustrate different upper fabrics which serve as canopies computable with certain the floors. Although their size and construction vary, they always have perimeter and single tape zippers on it which mate with the ones on the bottom fabrics.

The center of the table of FIG. 11 specifies a needed number of each of the main system components in the first row to assemble each of the various embodiments in the first column.

As it is seen from the table of FIG. 11, the embodiments illustrated therein require either a single circled or two connected semi-circled bottom fabrics at the tent bottom.

Figure 12:
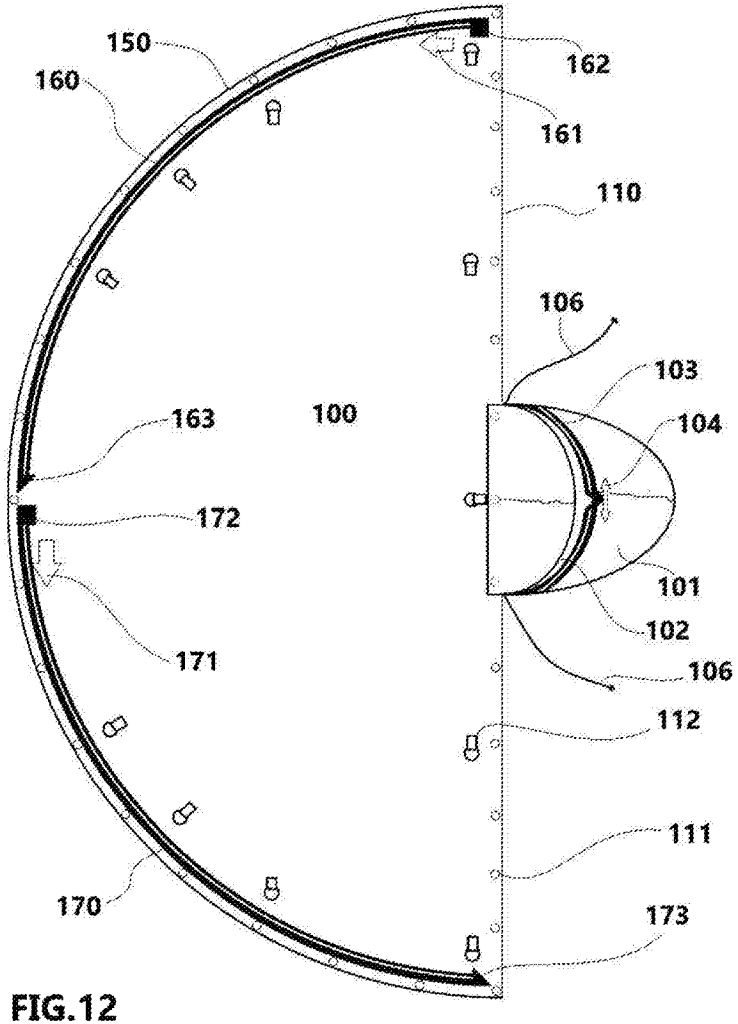

FIGS. 12 and 13 illustrate respective top and bottom views of the surface of the semi-circled bottom fabric 100 according to embodiments of the present inventions. The bottom fabric 100 is a quite versatile component. Curved line 150 and straight line 110 form part of the perimeter of the bottom fabric 100. The hood 101 is turned inside out on FIG. 12, so that zipper 103, symbolized by two bold lines, at hood's front perimeter 102, could be seen. It is closed-end type zipper and has only one slider 104, which closes the two tapes of zipper 103 into the direction of perimeter 110, where the zipper stops are situated. This zipper is used in order to adjust for the face of the user when bottom fabric 100 is used as a cape. Alternatively, strings 106, situated in a sleeve at the perimeter 102, could be used to adjust for the user's face Zipper 103 is also used as one of the doors of a pouch, formed when storing the cape into its hood 101, which is explained later.

Figure 49:
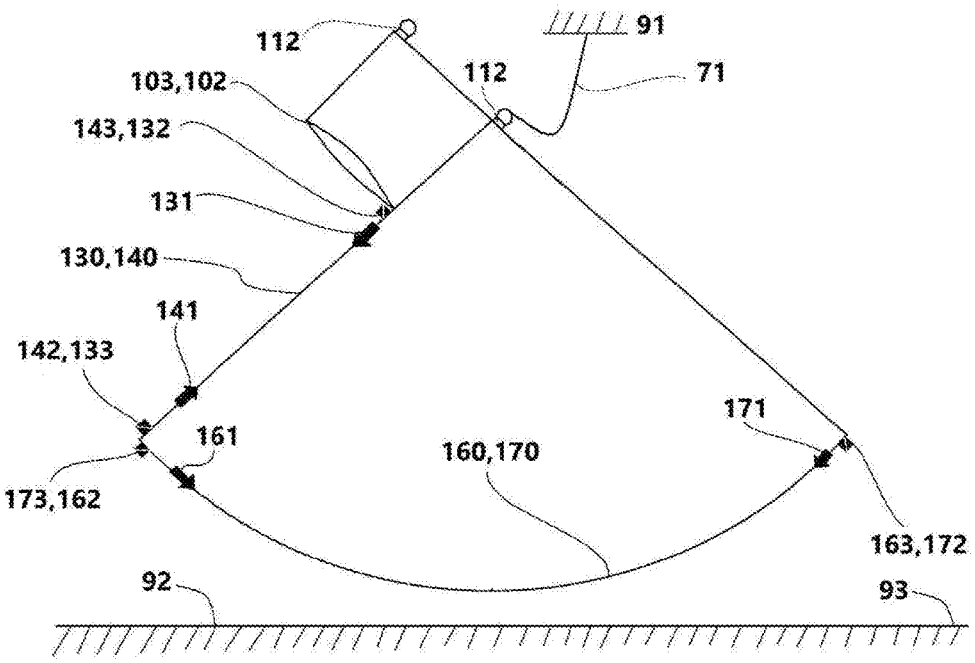
FIG. 49 illustrates a side view of a semi-circled bottom fabric folded in half according to embodiments of the present inventions.

Other elements are grommets 111 and rings, 112 situated close to perimeters 150 and 110. Grommets 111, which could alternately be rings or loops, are situated in the vicinity of the increments of 10° at perimeter 150 and their corresponding trajectories at perimeter 110. They are used for adjustment of the size of the cape, for connecting guy lines and ropes which run through these grommets so that two capes could be connected together to form a hammock. Rings 112, which could alternately be grommets, short ropes or loops, are situated in the vicinity of the increments of 30° and 45° at perimeter 150, in the vicinity of ¼ and ¾ of and the middle of perimeter 110, as well as the back angle of the hood 101 (FIG. 49). They are used to stretch the fabric when tub is formed when bottom fabric 100 is used as a tent bottom (FIG. 45), as well as when forming single person cape tent (FIG. 49) Sleeves 113 with strings 114 inside them, with adjustable length, by the mechanisms 115, could be optionally installed. These radially extending sleeves 113, strings 114, and mechanisms 115 serve as tensioners used for length adjustment when the bottom fabric 100 is used as a cape by less tall users.

Two single-tape zippers, 160 and 170, circumscribe perimeter 150. Zipper 160 starts with box 162, symbolized with a square, ends with pin 163, symbolized with a triangle, and has slider 161, symbolized with an arrow. Zipper 170 starts with box 172, ends with pin 173, and has slider 171.

In another preferred embodiment, the single string zippers 160 and 170 could be the two halves of a single, open-end type zipper, with a slider 171, box 172, pin 163, and zipper stops 173, and 162, while slider 161 would not exist.

On the other side of the bottom fabric 100', FIG. 13, two single-tape zippers, 130 and 140, are visible at the perimeter 110. Zipper 130 starts with box 132, ends with pin 133, and has slider 131. Zipper 140 starts with box 142, ends with pin 143, and has slider 141. Zippers 130 and 140 could be connected together to form tent door, or part of it, in the different tent embodiments, or front opening when the bottom fabric 100 is used as a cape. The hood is in correct position now—inside in—so the zipper 103 at the hood is no longer visible.

Zipper 120 is an open-end type zipper with two tapes situated symmetrically in relevance to the middle of perimeter 110. Its elements are box 122, pin 123, slider 121, and two zipper stops 124. It closes starting from the middle of perimeter 110 by inserting the pin 123 into the receptacle box 122 through the slider 121. Zipper 120 is used for adjustments for the neck of the user, when used as a cape. It is also used as one of the doors of a pouch, formed when storing the cape into its hood. Furthermore, it could be used as a place where a bug net could be attached. Alternatively, snaps or buttons can be used in place of the two opposing tapes of zipper 120 with pin 123, box 122 and slider 121. When using snaps, male snaps would go on one half and female snaps on the other half. When using buttons, button holes would go on one half and buttons on the other half.

In the preferred embodiment the approximate radius of the semi-circled bottom fabric 100 is 59 inches, the approximate length of zippers 160 and 170 is 91 inches, the approximate length of zippers 130 and 140 is 51 inches, while the length of zippers 120 and 103 is 14 inches. The hood is made out of two, square shaped fabrics of fabric, sewn at two sides, with dimension 14 by 14 inches approximately.

In another preferred embodiment, the zippers 120, 130 and 140, could be substituted with only one single string zipper 130, running from end to end the perimeter 110.

In another preferred embodiment, the single string zippers 130 and 140 could be the two halves of a single, open-end type zipper with a slider 131, box 132, pin 143, and zipper stops 133, and 142, while slider 141 would not exist.

The bottom water-proof fabric has a hood and is convertible into a cloak. A perimeter of the bottom water-proof fabric is substantially a circle and the hood is located near the center of the circle to be convertible into a poncho. Alternatively, the perimeter of the bottom water-proof fabric is a semi-circle of a substantially curved edge and a substantially straight edge and the hood is located near the center of the substantially straight edge to be convertible into a cape.

Figures 14, 15, 16, 17:
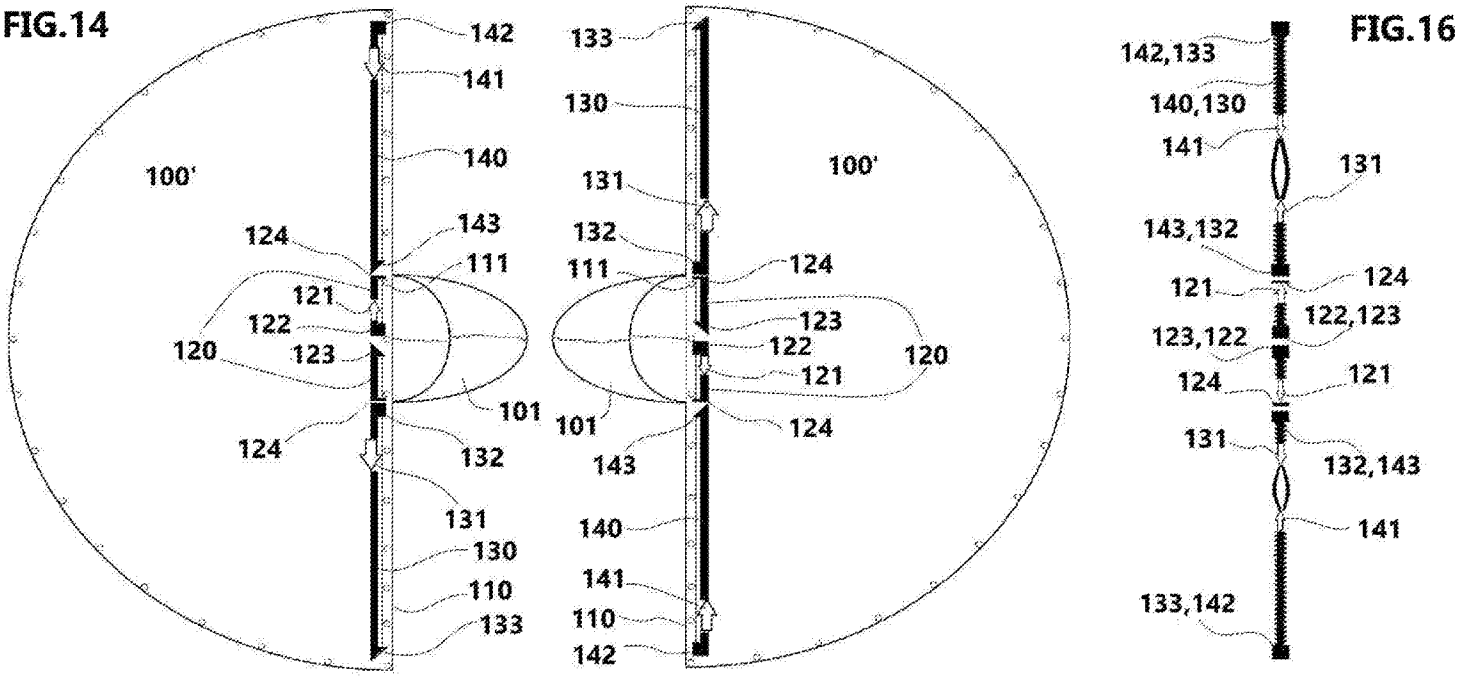
FIG. 14 illustrates a top view of three zippers to connect two semi-circled bottom fabrics aligned to form a circled shape bottom fabric according to embodiments of the present inventions.
FIG. 15 illustrates a cross section diagram of examples of horizontally aligned flaps and ends at a seam interface of the two semi-circled bottom fabrics aligned together, before the zippers are closed, when the two semi-circles are put together to form a circle according to embodiments of the present inventions.
FIG. 16 illustrates an end view of three zippers with their sliders pulled and the zippers nearly closed when connecting the two semi-circled bottom fabrics to form a circled shape bottom piece according to embodiments of the present inventions.
FIG. 17 illustrates a cross section diagram of examples of both vertically and horizontally aligned flaps and ends at a seam interface of the two semi-circled bottom fabrics aligned together, when the two semi-circles are put together, to form a circle, according to embodiments of the present inventions.

FIG. 14 illustrates a top view of three zippers 120, 130 and 140 used to connect two bottom fabrics 100' to form a circled shape bottom fabric according to embodiments of the present inventions. Namely, pins 133 of each of the bottom fabrics are inserted into boxes 142 of the other bottom fabric through sliders 141. Pins 143 of each of the bottom fabrics are inserted into boxes 132 of the other bottom fabric through sliders 131. Then, pins 123 of each of the bottom fabric are inserted into boxes 122 of the other bottom fabric through sliders 121. Finally, the illustrated sliders are pulled and the zippers are closed—FIG. 16. When such circled floor is made, the position of sliders 131 and 141 can vary, or not all connections would be compete at the 110-150 crossing, so that zippers 140 and 130 could be used as tent doors.

FIG. 15 illustrates a cross section diagram of examples of horizontally aligned flaps and ends at a seam interface of the two semi-circles aligned together, before the zippers are closed the moment when the two semi-circled bottom fabric 100 are put together. For exemplary purposes, two typical zipper elements 125 and part of the zipper 120 are available to establish the connection. Below this connection the perimeters 110 and hoods 101 of both semi-circled bottom fabric 100 are available to overlap. A ziplock-style strip 116 has female 117 and male 118 parts at its edge available to overlap and connect with a water-proof seal. This ziplock-style strip 116 is sometimes commonly referred to using the trademark "ZIPLOC". Grommets 111 are illustrated through the perimeters 110 of the semi-circles 100 in the cross-section of FIG. 15. All elements are attached together by waterproofed seams 152 and 153. Alternatively, ultrasonic welding could be used.

Alternatively, instead of ziplock-style strip, a strip with snaps could be used instead.

FIG. 16 illustrates an end view of three zippers 120, 130 and 140 with their sliders pulled and the zippers nearly closed when connecting the two semi-circled bottom fabric 100' to form a circled shape bottom fabric according to embodiments of the present inventions.

In the preferred embodiment in which there is only one single string zipper 130, running the perimeter 110 from end to end and connecting the two semi-circles, the pin 133 of each is inserted into the box 132 through the slider 131, of the other.

In the preferred embodiment in which zippers 130 and 140 are two halves of a single, open-end type zipper, 133 and 142 would be zipper stops and sliders 141 would not exist.

FIG. 17 illustrates a cross section diagram of examples of both vertically and horizontally aligned flaps and ends at a seam interface of the two semi-circled bottom fabric aligned and zipped together FIG. 18 and FIG. 19 illustrate respective top and bottom views of the surface of one preformed circled bottom fabric 200 according to embodiments of the present inventions.

FIG. 18 illustrates a top view of the outside surface of the bottom fabric 200. It has perimeter 250, circumscribed by four single-tape zippers—260, 270, 280 and 290. Zipper 260 has slider 261, box 262 and pin 263. Zipper 270 has slider 271, box 272 and pin 273. Zipper 280 has slider 281, box 282 and pin 283. Zipper 290 has slider 291, box 292 and pin 293. Throughout the perimeter, in the vicinity of the increments of 10°, are situated grommets 211. There are also rings, or loops, 212, attached to the fabric close to the perimeter, in the vicinity of the increments of 30° and 45°, as well as close to the back corners of the hood 201. The hood 201 is turned inside out in order to make visible a close-end type zipper 203 with slider 204 at the inside of the face perimeter 202. It is used for storing the bottom fabric 200 into its hood by forming a pouch. The close-end type zipper 203 is also used for face opening adjustment. Alternatively, strings 206, situated into preformed sleeves, which circumscribe the hood perimeter 202, could be used too. Other elements are the closed-end zippers 240 with sliders 241, which partly separates the fabric close to the perimeter 250, front and back of the hood 201. These are a useful feature when forming tent door of the shelter constructions embodiments, which are described later.

In another preferred embodiment, the single string zippers 260 and 270 could be the two halves of a single, open-end type zipper with a slider 271, box 272, pin 263, and zipper stops 273, and 262, while slider 261 would not exist. And also, the single string zippers 280 and 290 could be the two halves of a single, open end type zipper with a slider 291, box 292, pin 283, and zipper stops 293, and 282, while slider 281 would not exist.

FIG. 19 illustrates a top view of the inside surface of the circled bottom fabric 200'. An opening 210 is left into the fabric. It is closed by a close-end type zipper 220, which has slider 221. This zipper could be waterproof. This opening allows the use of the bottom fabric 200 as a poncho. For adjusting the size, optional sleeves 213 with strings inside them 214, length adjustable with mechanisms 215 could be preinstalled. Sleeves 213 with strings 214 inside them, with adjustable length, by the mechanisms 215, could be optionally installed. These radially extending sleeves 213, strings 214, and mechanisms 215 serve as tensioners used for length adjustment when the bottom fabric 200 is used as a poncho by short users.

FIG. 20-23 illustrates a side view of basic elements of exemplary a tent poles 50, assembled and disassembled, according to embodiments of the present inventions. As seen on FIG. 20, the basic element of a tent pole 50 is the pole segment 51. A segment usually is a hollow cylindrical body, with a female end 52. A tent pole usually is a combination of such segments, each inserted into the next, kept for convenience together with a bungee 53 running through them, as seen on FIG. 21 In set position, the segments' male ends are inserted into the female ends—FIG. 22. The length of one such pole could be extended by inserting additional, non-bungee connected, segments. Alternatively, one of the tent pole segments could have female ends 52 on both sides, thus making the whole pole female on both sides. This is useful when special tent stacks are used, designed to be inserted in tent pole female ends. In retracted position the poles' segments are stored in parallel to each other—FIG. 23

With the help of tent poles 50, extendable when needed by segments 51, a series of different size tents could be constructed using at the bottom a full circled bottom fabric 200 or one or two semi-circled bottom fabric 100. This is done by the use of series of upper fabrics specially designed to serve as tent canopies for a particular use and each time the tent footprint of these bottom fabrics is arranged in a different manner.

A tent, designed to provide volume enough for two average size persons, as well as its basic elements, is illustrated in FIGS. 24-27 for the alternative embodiments described herein.

Figure 24:
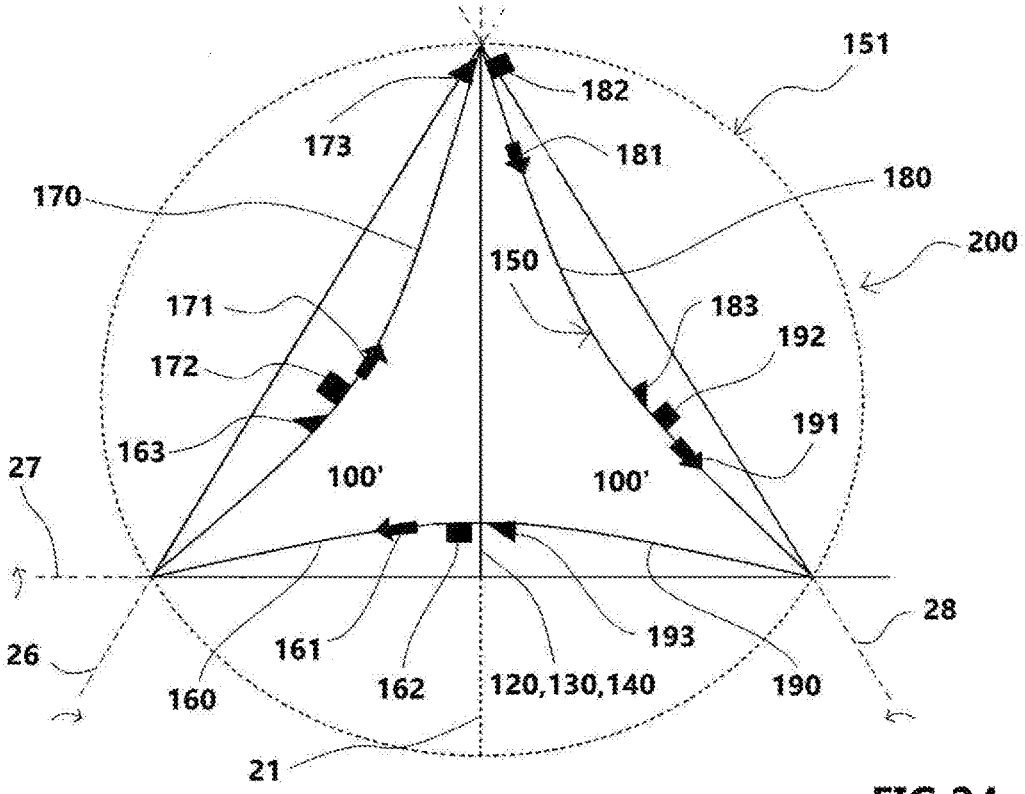
FIG. 24 illustrates a top view of the inside surface of a circled bottom piece, or two connected semi-circled bottom fabrics, lied down on the ground and folded in order to provide a triangular two person tent floor and parts of tent walls, according to embodiments of the present inventions.

FIG. 24 illustrates a top view of the inside surface of a circled bottom fabric 200, lied down on the ground. Alternatively, two semi-circled bottom fabrics 100, connected together as described on FIG. 14-17, could be used as well. Parts of their perimeter 150 is being lifted up and pivoted at lines 26, 27, and 28, away from the starting position 151, effectively forming an equilateral, triangular-shaped, tent footprint and part of the tent walls. Four single tape zippers circumscribe the perimeter 150-160, 170, 180, and 190. Zipper 160 has slider 161, box 162, and pin 163. Zipper 170 has slider 171, box 172, and pin 173. Zipper 180 has slider 181, box 182, and pin 183. Zipper 190 has slider 191, box 192 and pin 193.

Figure 25:
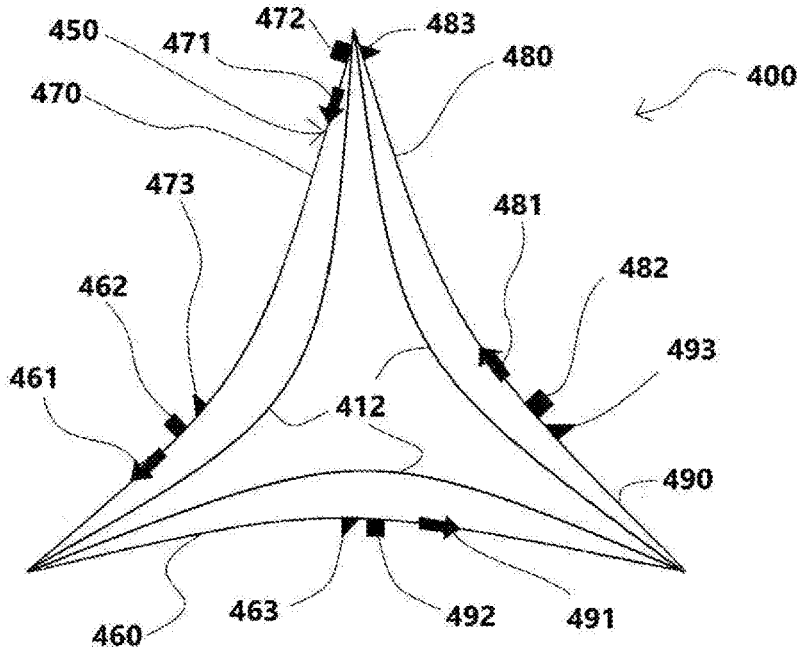
FIG. 25 illustrates a top view of an upper fabric with a three dimensional special shape, designed to serve as a canopy and provide the two person volume over the triangular tent-floor according to embodiments of the present inventions.

FIG. 25 illustrates a top view of an upper fabric with a three dimensional special shape, designed to serve as a tent canopy and provide the two person volume over the triangular foot print tent bottom. Three sleeves 412, or multiple of loops, situated at its surface would provide accommodation for the tent poles, which would support the construction. In embodiments such as the tent canopy of FIG. 25, the upper fabric is supported by one or more support poles, each support pole crossing at a different portion of a surface of the upper fabric. In other embodiments for tent canopies, poleless variants of the embodiments can be achieved by a support at a central portion of a surface of the upper fabric. Examples will be described with reference to FIG. 49 where a short rope holds up the tent upper fabric. One end of the rope connects to the tent upper fabric via grommets or loops at a central portion. Another end of the short rope is secured to a high point, such as a branch of a tree.

Four single tape zippers circumscribe the upper fabric perimeter 450-460, 470, 480, and 490. Zipper 460 has slider 461, box 462, and pin 463. Zipper 470 has slider 471, box 472, and pin 473. Zipper 480 has slider 481, box 482 and pin 483. Zipper 490 has slider 491, box 492, and pin 493.

In another preferred embodiment, the single string zippers 460 and 470 could be the two halves of a single, open-end type zipper with a slider 461, box 462, pin 473, and zipper stops 463, and 472, while slider 471 would not exist. And also, the single string zippers 480 and 490 could be the two halves of a single, open end type zipper with a slider 481, box 482, pin 493, and zipper stops 483, and 492, while slider 491 would not exist.

Figure 26:
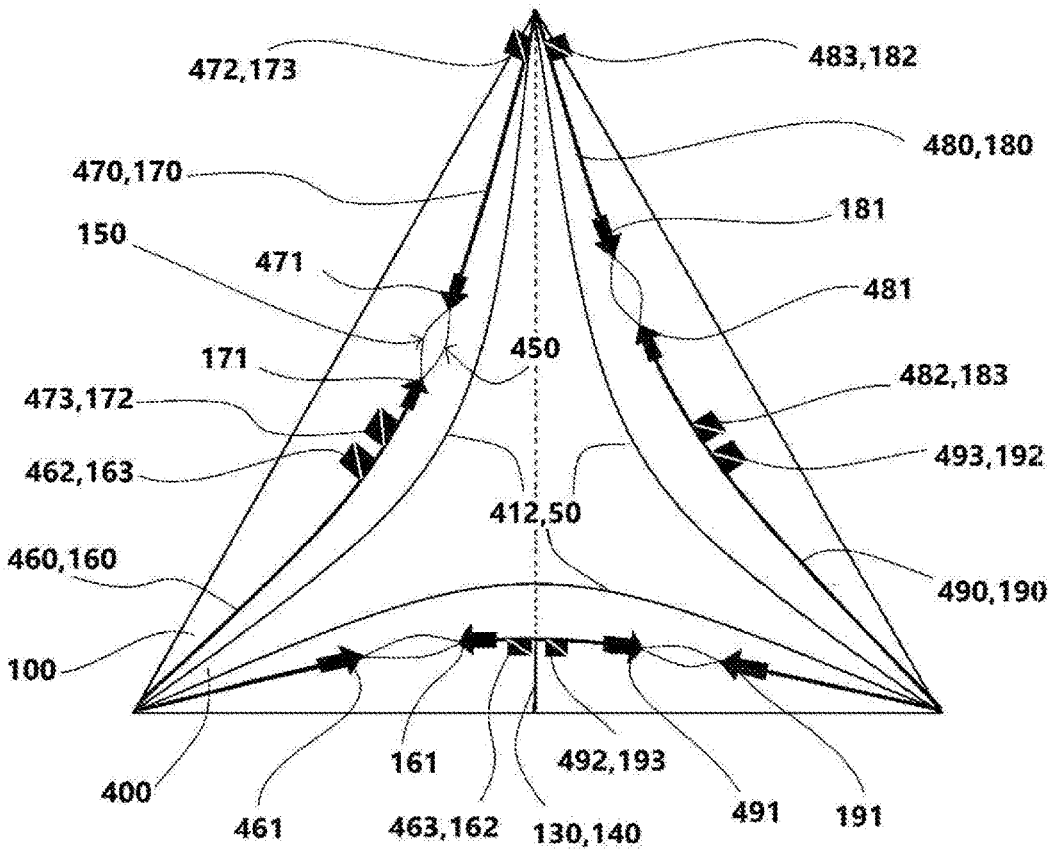
FIG. 26 illustrates a top view of the newly formed tent—a combination of the canopy, made by the upper fabric from FIG. 25, situated on top of the tent floor and parts of walls, made by the bottom fabric from FIG. 24, according to embodiments of the present inventions.

FIG. 26 illustrates a top view of the newly formed tent—a combination of the upper fabric from FIG. 25 situated on top of the bottom fabric from FIG. 24. This is done by inserting poles 50 into the sleeves 412 and connecting the zippers at the perimeters of the bottom and upper fabrics. In order for the zippers to mate, they must be identical, but run in opposite directions. To form connection between zippers 160 and 460, pin 163 is inserted through slider 461 into box 462 and pin 463 is inserted through slider 161 into box 162. Then the two sliders 161 and 461 are slid towards each other effectively closing the zippers 160 and 460 together. To form connection between zippers 170 and 470, pin 173 is inserted through slider 471 into box 472 and pin 473 is inserted through slider 171 into box 172. Then the two sliders 171 and 471 are slid towards each other effectively closing the zippers 170 and 470 together. To form connection between zippers 180 and 480, pin 183 is inserted through slider 481 into box 482 and pin 483 is inserted through slider 181 into box 182. Then the two sliders 181 and 481 are slid towards each other effectively closing the zippers 180 and 480 together. To form connection between zippers 190 and 490, pin 193 is inserted through slider 491 into box 492 and pin 493 is inserted through slider 191 into box 192. Then the two sliders 191 and 491 are slid towards each other effectively closing the zippers 190 and 490 together.

Figure 27:
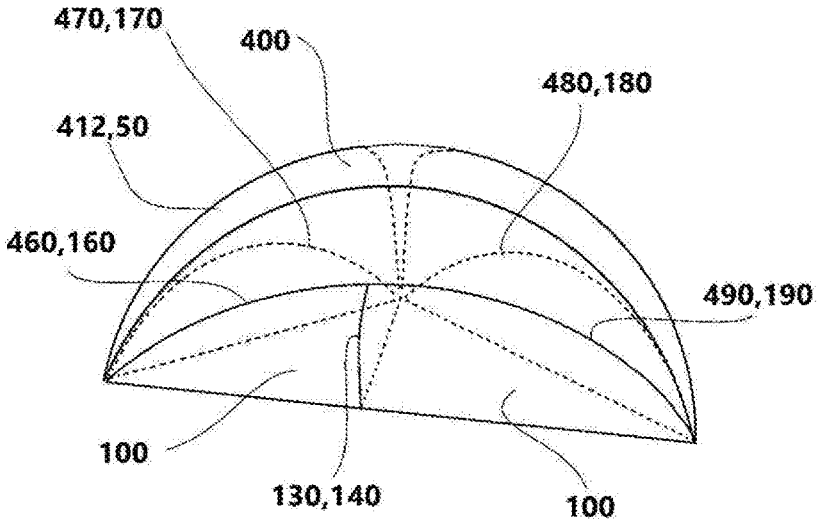
FIG. 27 illustrates a view in perspective of the newly formed tent according to embodiments of the present inventions.

FIG. 27 illustrates a view in perspective of the newly formed tent. Visible are the elements which form the enclosed compartment—the upper fabric 400 on top of the two bottom fabrics 100, the zipper connections between them, and the poles 50 which run through sleeves 412. The zippers connection 130,140 could be used as a door or be part of a door.

A tent, designed to provide volume enough for three average size persons, or two above average, as well as its basic elements, is illustrated in FIGS. 28-31 for the alternative embodiments described herein.

Figure 28:
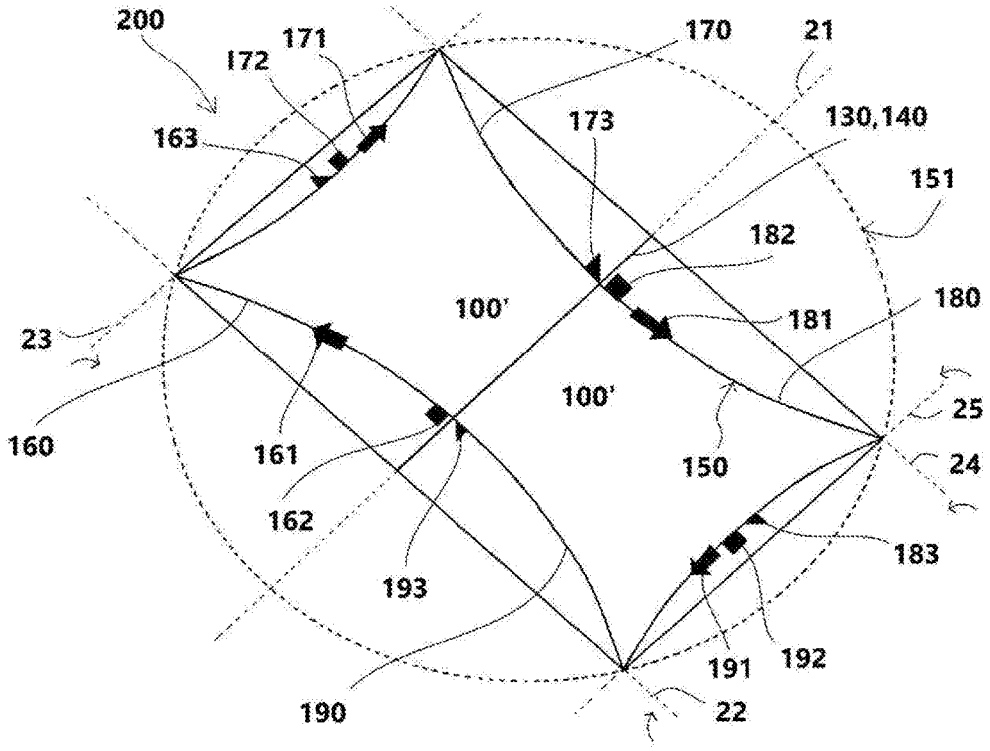
FIG. 28 illustrates a top view of the inside surface of a circled bottom fabric, or two connected semi-circled bottom fabrics, lied down on the ground and folded in order to provide a rectangular three person tent floor and parts of tent walls, according to embodiments of the present inventions.

FIG. 28 illustrates a top view of the inside surface of a bottom fabric 200, lied down on the ground. Alternatively, two semi-circled bottom fabrics 100, connected together as described on FIGS. 14-17, could be used as well. Parts of their perimeter 150 is being lifted up and pivoted at lines 22, 23, 24 and 25, away from the starting position 151, effectively forming a rectangular shaped tent footprint and part of the tent walls. Four single tape zippers circumscribe the perimeter 150-160, 170, 180, and 190. Zipper 160 has slider 161, box 162, and pin 163. Zipper 170 has slider 171, box 172, and pin 173. Zipper 180 has slider 181, box 182, and pin 183. Zipper 190 has slider 191, box 192, and pin 193.

Figure 29:
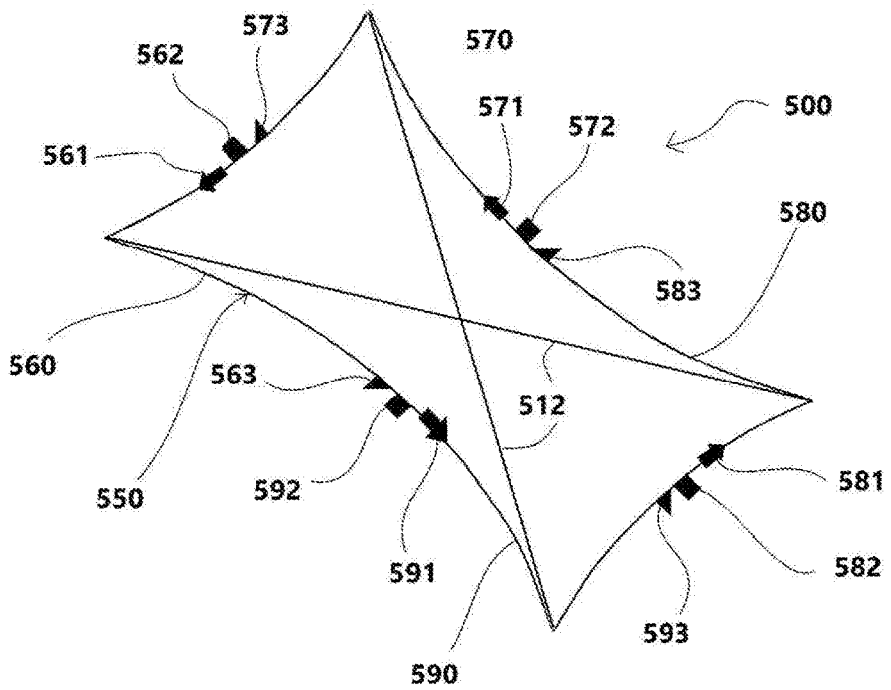
FIG. 29 illustrates a top view of an upper fabric with a three dimensional special shape, designed to serve as a canopy and provide the three person volume over the rectangular tent floor according to embodiments of the present inventions.

FIG. 29 illustrates a top view of a three dimensional upper fabric with a special shape, designed to serve as a tent canopy and provide the three person volume over the rectangular foot print tent bottom. Two sleeves 512, or multiple loops, situated at its surface would provide accommodation for the tent poles, which would support the construction. Four single tape zippers circumscribe the upper fabric perimeter 550-560, 570, 580 and 590. Zipper 560 has slider 561, box 562, and pin 563. Zipper 570 has slider 571, box 572 and pin 573. Zipper 580 has slider 581, box 582 and pin 583. Zipper 590 has slider 591, box 592, and pin 593.

In another preferred embodiment, the single string zippers 560 and 570 could be the two halves of a single, open-end type zipper with a slider 561, box 562, pin 573, and zipper stops 563, and 572, while slider 571 would not exist. And also, the single string zippers 580 and 590 could be the two halves of a single, open end type zipper with a slider 581, box 582, pin 593, and zipper stops 583, and 592, while slider 591 would not exist.

Figure 30:
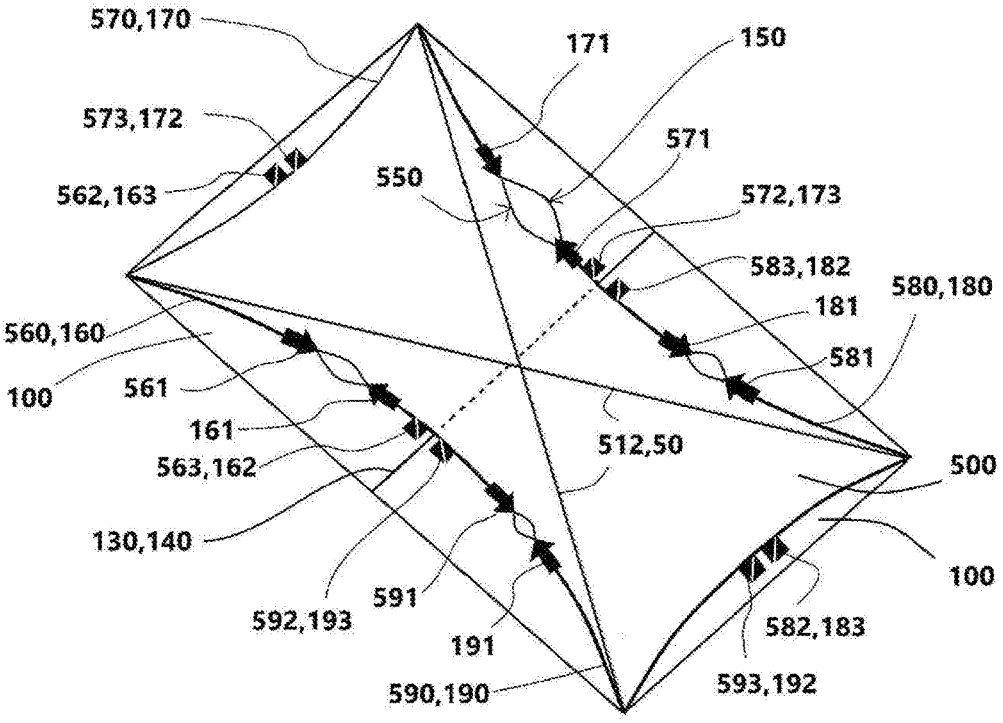
FIG. 30 illustrates a top view of the newly formed tent—a combination of the canopy, made by the upper fabric from FIG. 29, situated on top of the tent floor and parts of walls, made by the bottom fabric from FIG. 28, according to embodiments of the present inventions.

FIG. 30 illustrates a top view of the newly formed tent—a combination of the upper fabric from FIG. 29 situated on top of the bottom from FIG. 28. This is done by inserting poles 50, each extended if needed with one or more additional segments 51, into the sleeves 512 and connecting the zippers at the perimeters of the bottom and upper fabrics. In order for the zippers to mate, they must be identical but run in opposite directions. To form connection between zippers160 and 560, pin 163 is inserted through slider 561 into box 562 and pin 563 is inserted through slider 161 into box 162. Then the two sliders 161 and 561 are slid towards each other effectively closing the zippers 160 and 560 together. To form connection between zippers 170 and 570, pin 173 is inserted through slider 571 into box 572 and pin 573 is inserted through slider 171 into box 172. Then the two sliders 171 and 571 are slid towards each other effectively closing the zippers 170 and 570 together. To form connection between zippers 180 and 580, pin 183 is inserted through slider 581 into box 582 and pin 583 is inserted through slider 181 into box 182. Then the two sliders 181 and 581 are slid towards each other effectively closing the zippers 180 and 580 together. To form connection between zippers 190 and 590, pin 193 is inserted through slider 591 into box 592 and pin 593 is inserted through slider 191 into box 192. Then the two sliders 191 and 591 are slid towards each other effectively closing the zippers 190 and 590 together.

Figure 31:
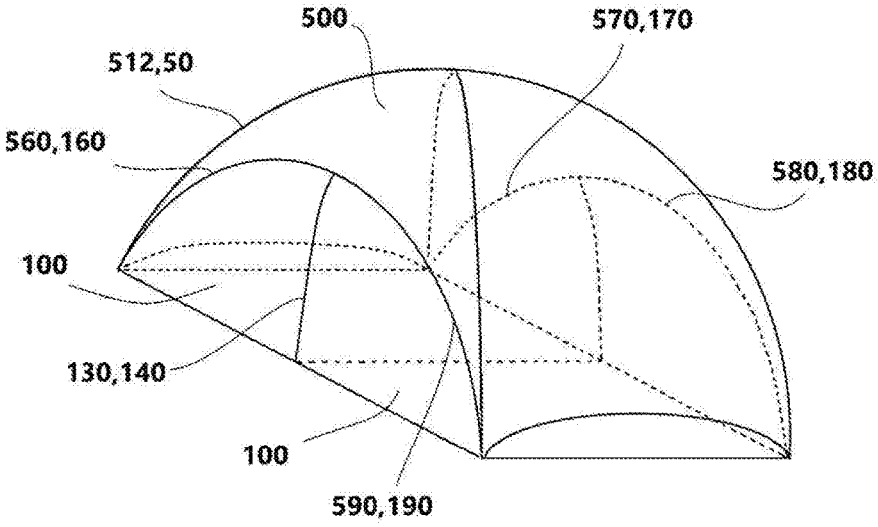
FIG. 31 illustrates a view in perspective of the newly formed tent according to embodiments of the present inventions.

FIG. 31 illustrates a view in perspective of the newly formed tent. Visible are the elements which form the enclosed compartment—the upper fabric 500 on top of the two bottom fabrics 100, the zipper connections between them, and the poles 50 which run through sleeves 512. The zippers connection 130,140 could be used as a tent door.

A tent, designed to provide volume enough for four average size persons as well as its basic elements, is illustrated in FIGS. 32-35 for the alternative embodiments described herein.

Figure 32:
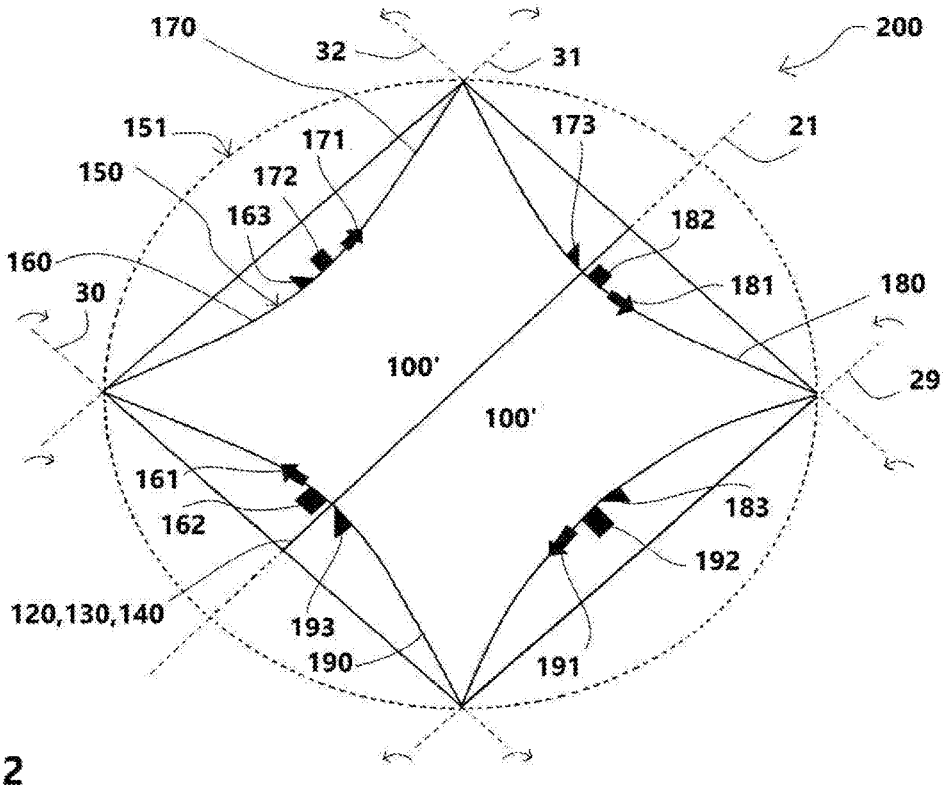
FIG. 32 illustrates a top view of the inside surface of a circled bottom fabric, or two connected semi-circled bottom fabrics, lied down on the ground and folded in order to provide a close to square four person tent floor and parts of tent walls, according to embodiments of the present inventions.

FIG. 32 illustrates a top view of the inside surface of a circled bottom fabric 200, lied down on the ground. Alternatively, two semi-circled bottom fabrics 100, connected together as described on FIGS. 14-17, could be used as well. Parts of their perimeter 150 is being lifted up and pivoted at lines 29, 30, 31 and 32, away from the starting position 151, effectively forming an almost square shaped tent footprint and part of the tent walls. Four single tape zippers circumscribe the perimeter 150-160, 170, 180 and 190. Zipper 160 has slider 161, box 162 and pin 163. Zipper 170 has slider 171, box 172 and pin 173. Zipper 180 has slider 181, box 182 and pin 183. Zipper 190 has slider 191, box 192 and pin 193.

Figure 33:
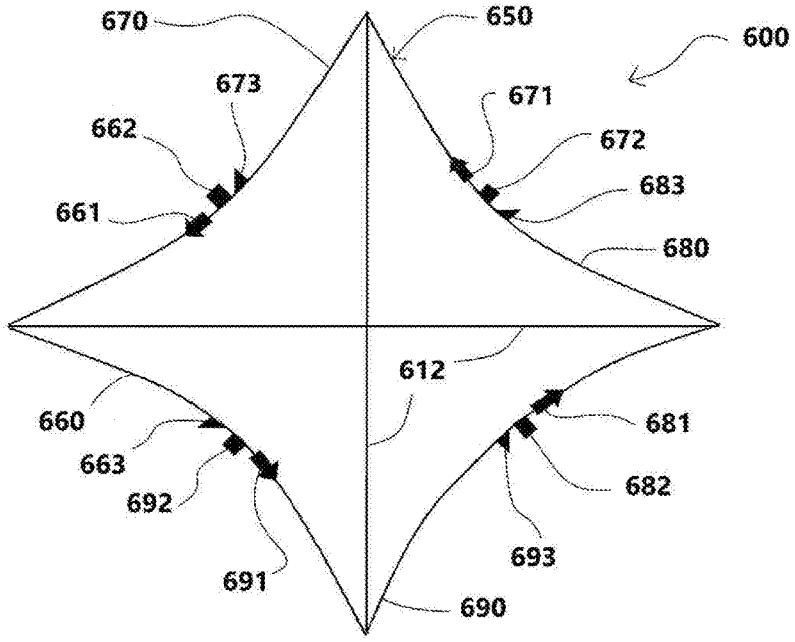
FIG. 33 illustrates a top view of an upper fabric with a three dimensional special shape, designed to serve as a canopy and provide the four person volume over the close to a square tent floor according to embodiments of the present inventions.

FIG. 33 illustrates a top view of an upper fabric with a three dimensional special shape, designed to serve as a tent canopy and provide the four person volume over the almost square footprint tent bottom. Two sleeves 612 situated at its surface would provide accommodation for the tent poles, which would support the construction. Four single tape zippers circumscribe the upper fabric perimeter 650-660, 670, 680 and 690. Zipper 660 has slider 661, box 662, and pin 663. Zipper 670 has slider 671, box 672, and pin 673. Zipper 680 has slider 681, box 682, and pin 683. Zipper 690 has slider 691, box 692, and pin 693.

In another preferred embodiment, the single string zippers 660 and 670 could be the two halves of a single, open-end type zipper with a slider 661, box 662, pin 673, and zipper stops 663, and 672, while slider 671 would not exist. And also, the single string zippers 680 and 690 could be the two halves of a single, open end type zipper with a slider 681, box 682, pin 693, and zipper stops 683, and 692, while slider 691 would not exist.

Figure 34:
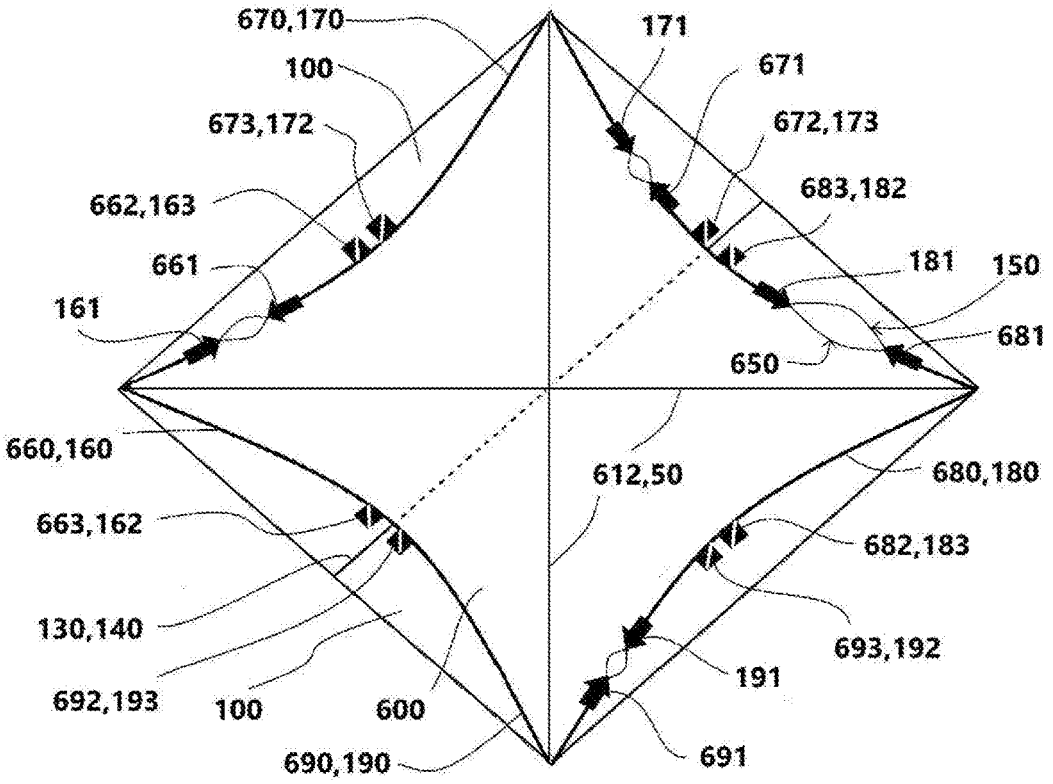
FIG. 34 illustrates a top view of the newly formed tent—a combination of the canopy, made by the upper fabric from FIG. 33, situated on top of the tent floor and pars of walls, made by the bottom fabric from FIG. 32, according to embodiments of the present inventions.

FIG. 34 illustrates a top view of the newly formed tent—a combination of the upper fabric from FIG. 33 situated on top of the bottom fabric from FIG. 32. This is done by inserting poles 50, each extended if needed with one or more additional segments, into the sleeves 612 and connecting the zippers at the perimeters of the bottom and upper fabrics. In order for the zippers to mate they must be identical but run in opposite directions. To form connection between zippers 160 and 660, pin 163 is inserted through slider 661 into box 662 and pin 663 is inserted through slider 161 into box 162. Then the two sliders 161 and 661 are slid towards each other effectively closing the zippers 160 and 660 together. To form connection between zippers 170 and 670, pin 173 is inserted through slider 671 into box 672 and pin 673 is inserted through slider 171 into box 172. Then the two sliders 171 and 671 are slid towards each other effectively closing the zippers 170 and 670 together. To form connection between zippers 180 and 680, pin 183 is inserted through slider 681 into box 682 and pin 683 is inserted through slider 181 into box 182. Then the two sliders 181 and 681 are slid towards each other effectively closing the zippers 180 and 680 together. To form connection between zippers 190 and 690, pin 193 is inserted through slider 691 into box 692 and pin 693 is inserted through slider 191 into box 192. Then the two sliders 191 and 691 are slid towards each other effectively closing the zippers 190 and 690 together.

Figure 35:
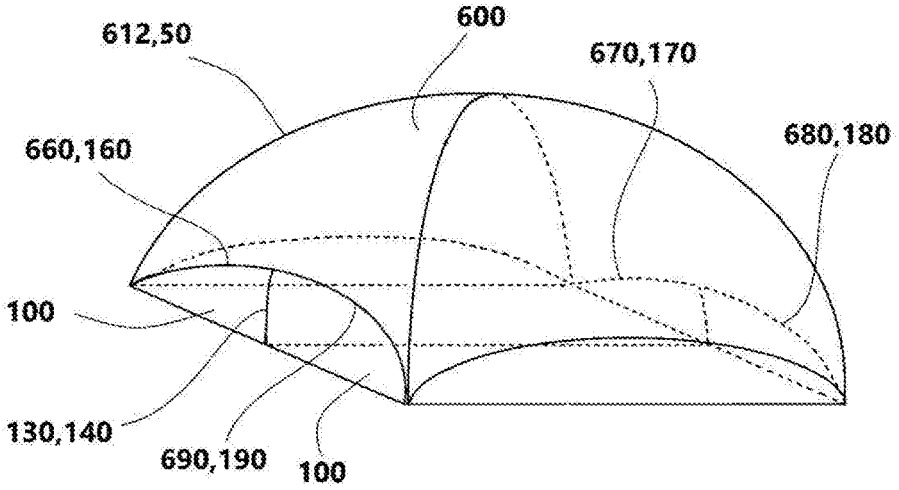
FIG. 35 illustrates a view in perspective of the newly formed tent according to embodiments of the present inventions.

FIG. 35 illustrates a view in perspective of the newly formed tent. Visible are the elements which form the enclosed compartment—the upper fabric 600 on top of the two bottom fabrics 100, the zipper connections between them, and the poles 50 which run through sleeves 612. The zippers connection 130,140 could be used as part of a tent door.

A tent, designed to provide volume enough for five average size persons as well as its basic elements, is illustrated in FIGS. 36-39 for the alternative embodiments described herein.

FIG. 36 illustrates a top view of the inside surface of a bottom fabric 200, lied down on the ground. Alternatively, two semi-circled bottom fabrics 100, connected together as described on FIGS. 14-17, could be used as well. Parts of their perimeter 150 is being lifted up and pivoted at lines 33, 34, 35, 36, 37 and 38, away from the starting position 151, effectively forming a hexagonal shaped tent footprint and part of the tent walls. Four single tape zippers circumscribe the perimeter 150-160, 170, 180 and 190. Zipper 160 has slider 161, box 162, and pin 163. Zipper 170 has slider 171, box 172, and pin 173. Zipper 180 has slider 181, box 182, and pin 183. Zipper 190 has slider 191, box 192 and pin 193.

FIG. 37 illustrates a top view of an upper fabric with a special shape, designed to serve as a tent canopy and provide the five person volume over the hexagonal foot print tent bottom. Three sleeves 712 situated at its surface would provide accommodation for the tent poles, which would support the construction. Four single tape zippers circumscribe the upper fabric perimeter 750-760, 770, 780 and 790. Zipper 760 has slider 761, box 762, and pin 763. Zipper 770 has slider 771, box 772, and pin 773. Zipper 780 has slider 781, box 782 and pin 783. Zipper 790 has slider 791, box 792 and pin 793.

In another preferred embodiment, the single string zippers 760 and 770 could be the two halves of a single, open-end type zipper with a slider 761, box 762, pin 773, and zipper stops 763, and 772, while slider 771 would not exist. And also, the single string zippers 780 and 790 could be the two halves of a single, open end type zipper with a slider 781, box 782, pin 793, and zipper stops 783, and 792, while slider 791 would not exist.

Figure 38:
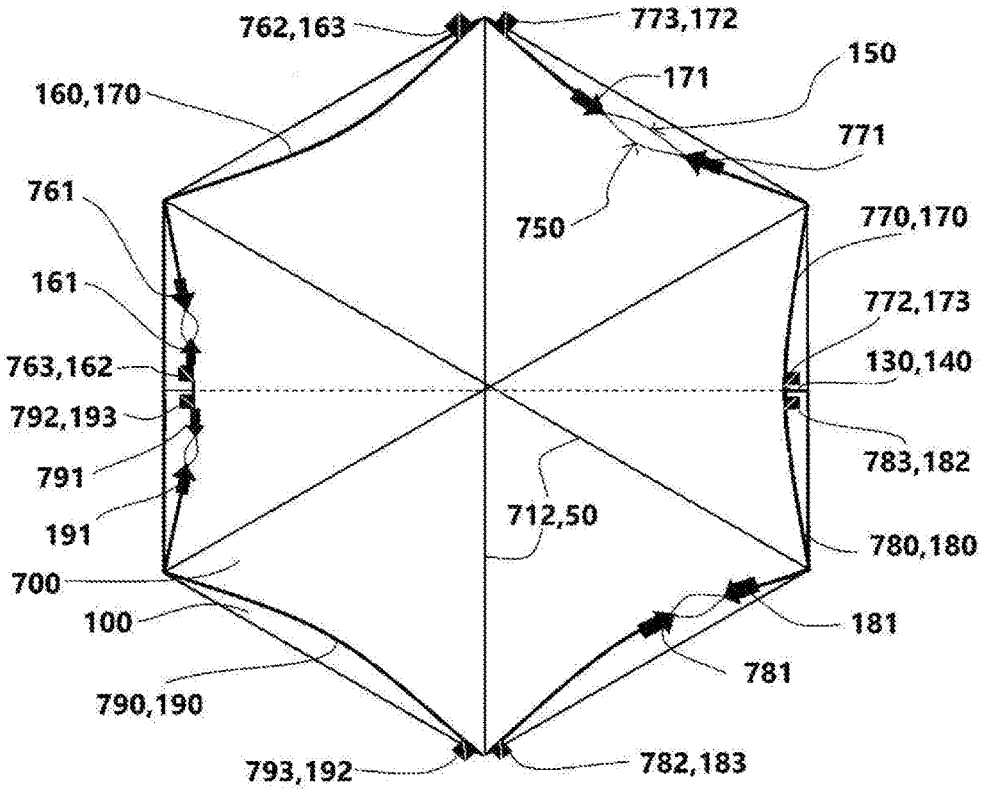
FIG. 38 illustrates a top view of the newly formed tent—a combination of the canopy, made by the upper fabric from FIG. 37, situated on top of the tent floor and parts of walls, made by the bottom fabric from FIG. 36, according to embodiments of the present inventions.

FIG. 38 illustrates a top view of the newly formed tent—a combination of the upper fabric from FIG. 37 situated on top of the bottom fabric from FIG. 36. This is done by inserting poles 50, each extended if needed with one or more additional segments, into the sleeves 712 and connecting the zippers at the perimeters of the bottom and upper fabrics. In order for the zippers to mate, they must be identical, but run in opposite directions. To form connection between 160 and 760, pin 163 is inserted through slider 761 into box 762 and pin 763 is inserted through slider 161 into box 162. Then the two sliders 161 and 761 are slid towards each other effectively closing the zippers 160 and 760 together. To form connection between 170 and 770, pin 173 is inserted through slider 771 into box 772 and pin 773 is inserted through slider 171 into box 172. Then the two sliders 171 and 771 are slid towards each other effectively closing the zippers 170 and 770 together. To form connection between 180 and 780, pin 183 is inserted through slider 781 into box 782 and pin 783 is inserted through slider 181 into box 182. Then the two sliders 181 and 781 are slid towards each other effectively closing the zippers 180 and 780 together. To form connection between 190 and 790, pin 193 is inserted through slider 791 into box 792 and pin 793 is inserted through slider 191 into box 192. Then the two sliders 191 and 791 are slid towards each other effectively closing the zippers 190 and 790 together.

Figure 39:
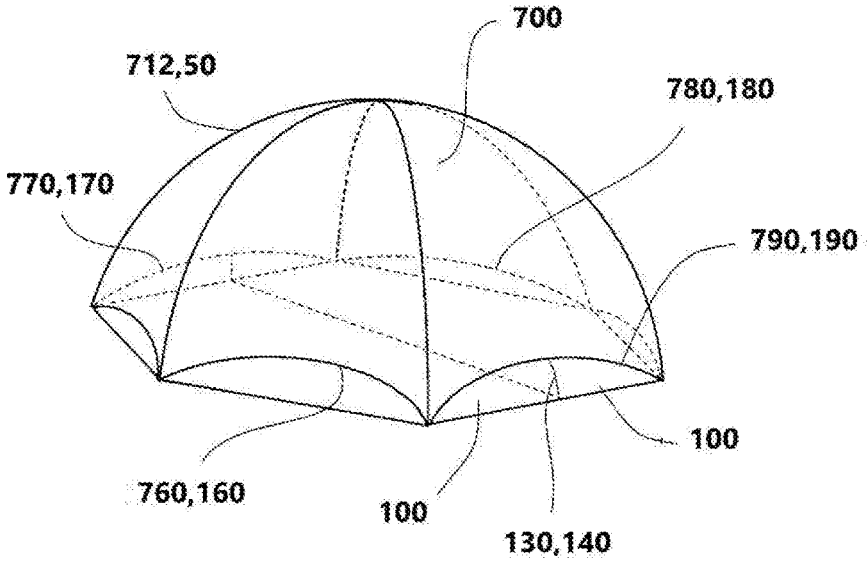
FIG. 39 illustrates a view in perspective of the newly formed tent according to embodiments of the present inventions.

FIG. 39 illustrates a view in perspective of the newly formed tent. Visible are the elements which form the enclosed compartment—the upper fabric 700 on top of the two bottom fabrics100, the zipper connections between them, and the poles 50 which run through sleeves 712. The zippers connection 130,140 could be used as part of a tent door.

The same principle could be employed to construct a tent, designed to provide volume enough for one person only. This is illustrated in FIGS. 40-43 for the alternative embodiments described herein.

FIG. 40 illustrates a top view of the inside surface of a semi-circled bottom fabric 100, lied down on the ground. Parts of its perimeter 150 are being lifted up and pivoted at lines 39 and 40, away from the starting position 151, effectively forming a triangle shaped tent foot print and part of the tent walls. Two single tape zippers circumscribe the perimeter 150-160 and 170. Two single tape and one open end zipper circumscribe the perimeter 110-130,140 and 120, respectively. Zipper 160 has slider 161, box 162, and pin 163. Zipper 170 has slider 171, box 172, and pin 173. Zipper 130 has slider 131, box 132, and pin 133. Zipper 140 has slider 141, box 142, and pin 143. Zipper 120, an open-end type zipper, is two parts, situated symmetrically around the middle of perimeter 110. Its elements are slider 121, box 122, and pin 123. At 120's both ends there are also zipper stops 124.

FIG. 41 illustrates a top view of an upper fabric with a three dimensional special shape, designed to serve as a tent canopy and provide the single person volume over the triangular foot print tent bottom. Two sleeves 812 situated at its surface would provide accommodation for the tent poles, which would support the construction. Five zippers circumscribe the upper fabric perimeters 850 and 810-860, 870, 830, 840 and 820. These zippers are exactly the same zippers as the zippers on FIG. 40, but run in opposite direction. Zipper 860 has slider 861, box 862 and pin 863. Zipper 870 has slider 871, box 872 and pin 873. Zipper 830 has slider 831, box 832, and pin 833. Zipper 840 has slider 841, box 842, and pin 843. Zipper 820 is two parts, situated symmetrically around the middle of perimeter 810. Its elements are slider 821, box 822, and pin 823. At 820's both ends there are also zipper stops 824.

In another preferred embodiment, the single string zippers 860 and 870 could be the two halves of a single, open-end type zipper with a slider 861, box 862, pin 873, and zipper stops 863, and 872, while slider 871 would not exist.

In another preferred embodiment, the zippers 820, 830 and 840, could be substituted with only one single string zipper 830, running from end to end the perimeter 810.

In another preferred embodiment, the single string zippers 830 and 840 could be the two halves of a single, open-end type zipper with a slider 841, box 842, pin 833, and zipper stops 843 and 832, while slider 831 would not exist.

FIG. 42 illustrates a top view of the newly formed tent—a combination of the upper fabric from FIG. 41 situated on top of the bottom fabric from FIG. 40. This is done by inserting poles 50 into the sleeves 812 and connecting the zippers at the perimeters of the bottom and upper fabrics. In order for the zippers to mate, they must be identical, but run in opposite directions. To form connection between 160 and 860 pin 163 is inserted through slider 861 into box 862 and pin 863 is inserted through slider 161 into box 162. Then the two sliders 161 and 861 are slid towards each other effectively closing the zippers 160 and 860 together. To form connection between 170 and 870 pin 173 is inserted through slider 871 into box 872 and in 873 is inserted through slider 171 into box 172. Then the two sliders 171 and 871 are slid towards each other effectively closing the zippers 170 and 870 together. To form connection between 130 and 830, pin 133 is inserted through slider 831 into box 832 and pin 833 is inserted through slider 131 into box 132. Then the two sliders 131 and 831 are slid towards each other effectively closing the zippers 130 and 830 together. To form connection between 140 and 840 pin 143 is inserted through slider 841 into box 842 and pin 843 is inserted through slider 141 into box 142. Then the two sliders 141 and 841 are slid towards each other effectively closing the zippers 140 and 840 together. To form connection between 120 and 820 pin 123 is inserted through slider 821 into box 822 and pin 823 is inserted through slider 121 into box 122. Then the two sliders 121 and 821 are slid away from each other, into direction of the two zipper stops 124 and the two zipper stops 184, thus effectively closing the zippers 120 and 820 together.

FIG. 43 illustrates is a view in perspective of the newly formed tent. Visible are the elements which form the enclosed compartment—the upper fabric 800 on top of the bottom fabric 100, the zipper connections between them, and the poles 50 which run through sleeves 812.

Figure 44:
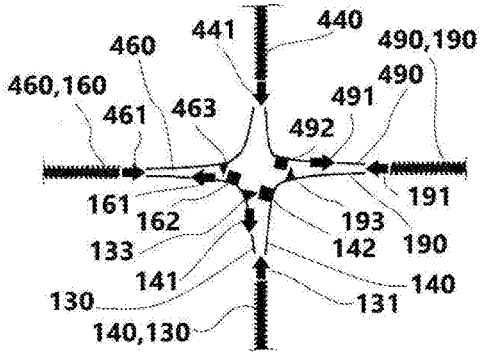
FIG. 44 illustrates a front view and explains how a typical tent door is formed by zippers, and also by zippers connecting the bottom fabric with the upper fabric, according to embodiments of the present inventions.

FIG. 44 illustrates a front view and explains how a typical tent door is formed by the zippers 130 and 140, and also by the zippers connecting the bottom fabric with the upper fabric. The configuration would vary from embodiment to embodiment. Sometimes, as on FIG. 31, when two bottom fabric are used, zipper connection 130,140 would provide door alone. In other cases, additional close-end zipper, 440 with slider 441, needs to be prefabricated in the upper fabric. The door is made by simply not connecting together all neighboring zippers around the points, where bottom fabric perimeters 110 and 150 meet. Pin 133 and box 142, pin 463 and box 162, and also pin 193 and box 492 are intentionally left unconnected—a door is formed. Sliders 461, 191, 131 as well as 441, if present, could close this opening, thus effectively closing the tent door. Alternatively, when a circular bottom fabric is used, zippers 240 (FIG. 18) take the place of zippers 130,140.

Figure 45:
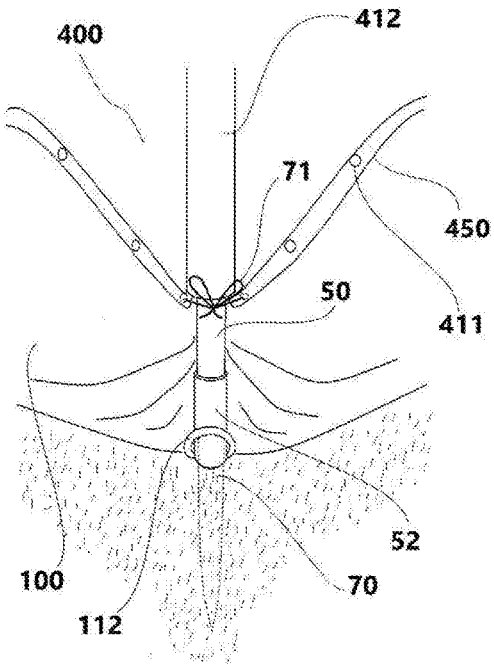
FIG. 45 illustrates a perspective view of a typical tent angle as seen from outside according to embodiments of the present inventions.

FIG. 45 illustrates a perspective view of a typical tent angle as seen from outside. FIG. 45 also demonstrates how the tub floor is formed. First, the bottom fabric 100 is placed on the ground. The upper fabric in use, for example 400, with poles 50 preinstalled, into the sleeves 412, is attached on top of the bottom fabric 100 as explained before. To stretch the bottom fabric, poles 50 are inserted into rings 112 and tent footprint's grommets, if additional tent footprint is used. Alternatively, as shown on FIG. 45, stacks 70 are inserted through rings 112 into the soil. Optionally, the other end of the stacks 70 is inserted into the pole's female ends 52. The perimeter of the upper fabric does not reach the ground, so when zippers 160 and 170 are connected to zippers 460 and 470, the tents angles go up a few inches, effectively forming the tub. Two distant points at the perimeter 150 of the bottom fabric get close together and get connected with little string, rings or hooks 71, thus forming a little pocket inside. The perimeter 450 of the upper fabric has the form of a placket which covers completely the zipper connection 460,160. Grommets 411 at the perimeter 410 are used to secure additionally the tent to the ground through guy lines. The outdoor shelter system rests with the bottom water-proof fabric 100 on the ground surface. Perimeter locations where the zippers mesh 450 are biased upward away from the ground surface by at least the support pole 50.

Figure 46:
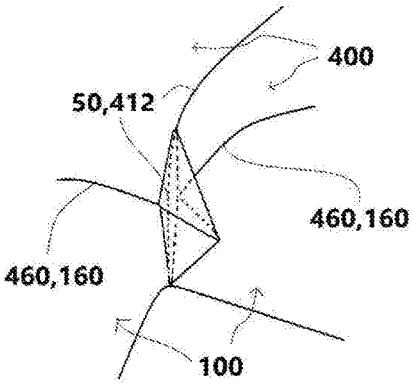
FIG. 46 illustrates a perspective view of a pocket visible at a typical tent angle as seen from within according to embodiments of the present inventions.

FIG. 46 illustrates a perspective view of the little pocket as visible from within. This pocket is formed, behind the tent poles at the angles where the tub is formed. Above the connection line 460,160 is the upper fabric 400, while bellow is bottom fabric 100. The pocket is in the middle, right above the tub angle. Such pocket—a good place for ventilation opening—could be embedded in the upper fabric construction, when designed. Alternatively, it could be formed on spot by connecting two of the grommets 411, closest to the pole 50 with a little rope 71, rings or hooks as seen on FIG. 45.

Figure 47:
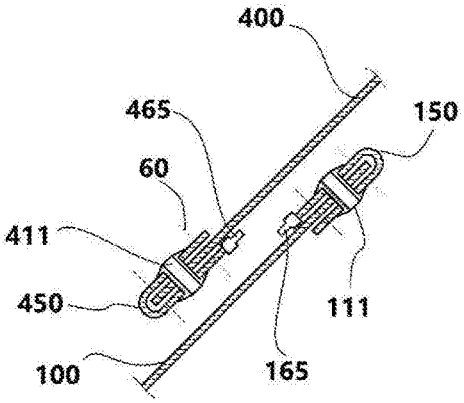
FIG. 47 and FIG. 48 demonstrate cross section of a typical point of the bottom and upper fabrics perimeters, before and after their connection, according to embodiments of the present inventions.
Figure 48:
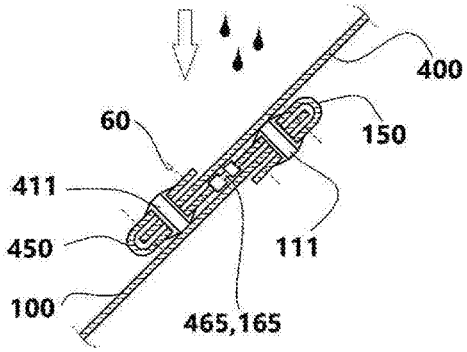

FIG. 47 and FIG. 48 demonstrate cross section of a typical point of connection of the bottom and upper fabric perimeters, 150 and 450 respectively. Practically, these perimeters are identical, except that their corresponding zippers run in opposite direction. Zipper elements, 165, part of zipper 160, face away from the perimeter 150 and zipper elements 465, part of zipper 460, face away from the perimeters 450. The perimeter 450 of the upper fabric has the form of a placket which covers completely the zipper connection 460, 160. The falling water would typically reach the surface 100 through seam 60 or grommet 411 first, but these points are below the zipper elements connection 465,165, which with the help of gravity, would prevent the water from entering the tent through the zipper connection 460,160.

FIG. 49 illustrates a side view of a semi-circled bottom fabric folded in half. Another useful feature of the semi-circled bottom fabric is its ability to be used as a cape. This is done by connecting zippers 130 and 140 of the perimeter 110 of the single semi-circle—see also FIG. 13. First, pin 143 is inserted through slider 131 into box 132. Then slider 131 is pulled to close the connection as needed. Zippers 103 and 120 could be closed partially to adjust for the user's face and neck respectively.

This is also a way to form a simple shelter. In addition to the above, zippers 160 and 170 at perimeter 150 are closed by inserting pin 163 through slider 171 into box 172, and also pin 173 is inserted through slider 161 into box 162. Then the two sliders 161 and 171, or just one of them, are pulled into direction of each other to form a fully enclosed compartment. Zippers 130 and 140 serve as a door of this newly formed simple shelter. This enclosed compartment could be attached at three points—one high 91, and two on the ground, 92 and 93. A grommets, or little loops 112, situated at the rear corners of hood 101, are used to connect, by a little rope 71, the bottom fabric 100 to a high point, 901, while grommets 111 at the middle and ends of perimeter 150 are used to connect the bottom fabric 100 to the ground with stacks.

Alternatively, for larger size users, the volume of the enclosed compartment of FIG. 49 could be further expanded by additional fabric, which has zippers at its perimeter, which mate and connect to the bottom fabric 100 perimeter zippers.

Figure 50:
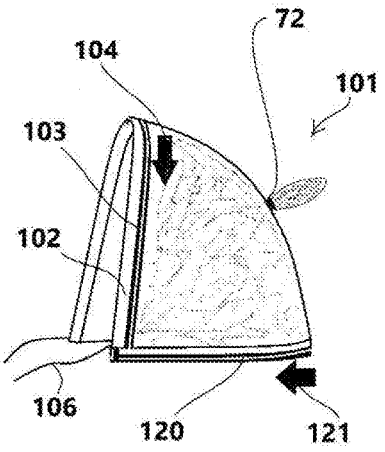
FIG. 50 illustrates and demonstrates ways for adjusting for the size of the hood of the bottom fabric, when used as a cape according to embodiments of the present inventions.

FIG. 50 illustrates and demonstrates ways for adjusting for the size of the hood of the bottom fabric 100, when used as a cape. First, it is turned inside out. The size of the hood 101 could be adjusted with a little rubber ring 72, while the openings for the neck and the face of the user could be adjusted by partly closing zippers 120 and 103 respectively. Alternatively, the face opening could be adjusted by ropes 106, which runs through preformed sleeve which circumnavigate the hood face perimeter 102.

Figure 51:
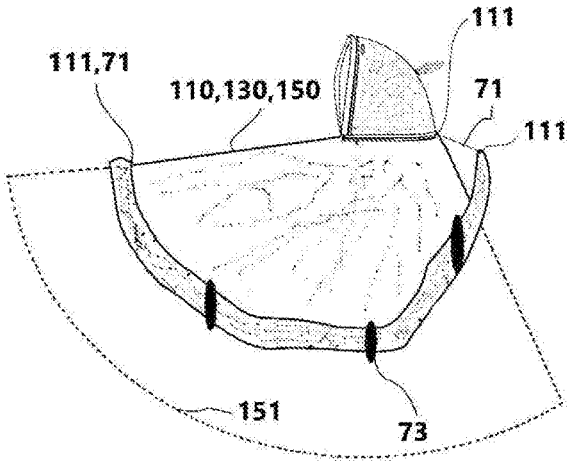
FIG. 51 illustrates a side view of a cape with an adjustment for the length of the cape according to embodiments of the present inventions.
Figure 52:
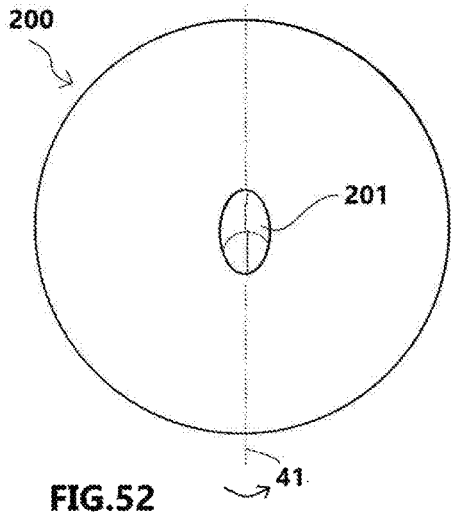
FIGS. 52-60 illustrate progressive steps of one way the bottom fabric could be folded and stored into its hood according to embodiments of the present inventions.
Figure 53:
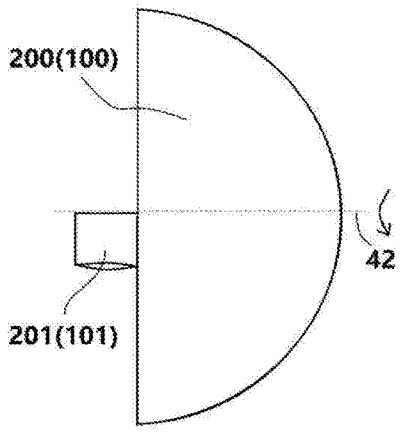
Figure 54:
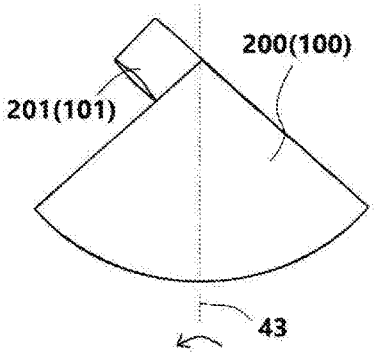
Figure 55:
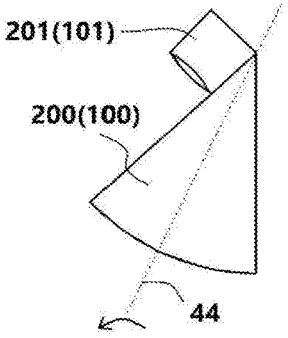
Figure 56:
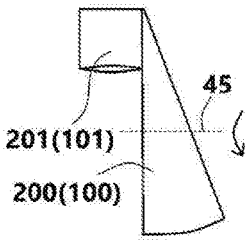
Figure 57:
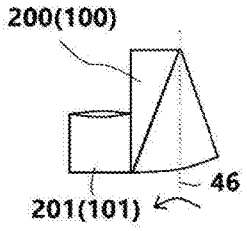
Figure 58:
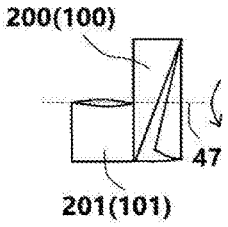
Figure 59:
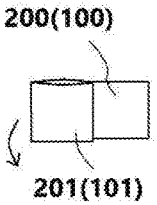
Figure 60:
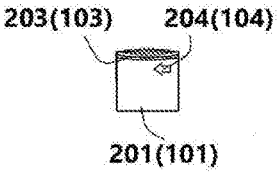

FIG. 51 illustrates an inside view of a cape with an adjustment for the length of the cape. The adjustment would depend on the weather conditions.

During a rainy and windy day, when the moisture released from the user's body is not an issue, usually what is important is to prevent the cape from flapping around. First, zippers 160, 170, 130, and 140 are closed tightly around the user and his backpack, as described on FIG. 49. Opening is left only for the user's limbs around where perimeters 110 and 150 meet. The extra cape material is kept inside together by a robber ring, similar to 72 but bigger, in a manner as described for the hood adjustment above. Alternatively, the zippers 160 and 170 are rolled up with the extra material and fixed with clamps or magnet couples 73.

During a rainy, but humid day with no wind, the moisture released from the body is an issue, so perimeters 110 and 150 need to stay as open as possible. A plurality of sleeves 113 and tensioners 114 are located within sleeves extending from near the hood and a perimeter of the bottom water-proof fabric to shorten a length when worn—(FIG. 13). These connect points at perimeter 150 with the middle of perimeter 110. Alternatively, such lines, if not prefabricated, could be installed by the user by connecting grommets 111 from perimeter 150 with the grommets in the middle of perimeter 110 by using ropes, rings or hooks 71.

Phantom line 151 shows where a perimeter 151 of the one semi-circled material 100 when draped as a cape would extend if the length were not adjusted.

The perimeter of the bottom water-proof fabric comprises ground stake attachments 112 spaced around the perimeter thereof and attached to the bottom water-proof fabric spaced inwardly a distance from the perimeter of the bottom water-proof fabric. The distance from the perimeter is chosen sufficient to shield weather elements from an interior of the outdoor weather system when the bottom water-proof fabric is deployed pulled upward at the ground stake attachment.

The perimeter of the bottom water-proof fabric comprises grommets 111 spaced around the perimeter.

The upper fabric has stake couplers on at least the perimeter of the upper fabric for accommodating stakes to hold down the outdoor shelter system. The stake couplers on the perimeter of the upper fabric can use guys connected to rings connected to grommets.

FIGS. 52-60 illustrate progressive steps of one way the bottom fabric could be folded and stored into its hood. Initially all the perimeter zippers are closed 220 to itself, 260 with 290 and 270 with 280 (120 to itself, 130 with 140 and 160 with 170) are closed, as described above on FIG. 49. Then the bottom fabric 200(100) is folded multiple times by pivoting at lines 41, 42, 43, 44, 45, 46 and 47, until it becomes as big as the hood 201(101). Then the hood is turned inside out to encompass the folded floor piece. Zipper 203(103) becomes exposed and the user pulls slider 204 (104) until it is closed completely, thus forming a little pouch or cushion.

Figure 61:
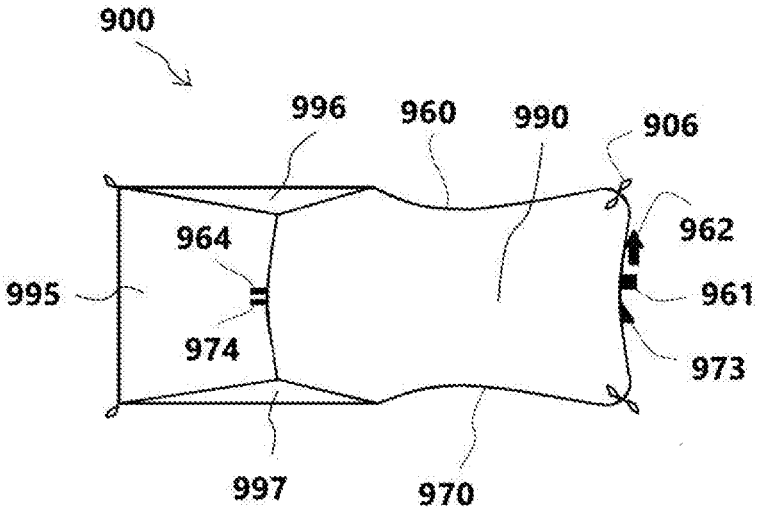
FIG. 61 illustrates a top view of an alternative extension embodiment for a bottom water-proof fabric according to embodiments of the present inventions.
Figure 62:
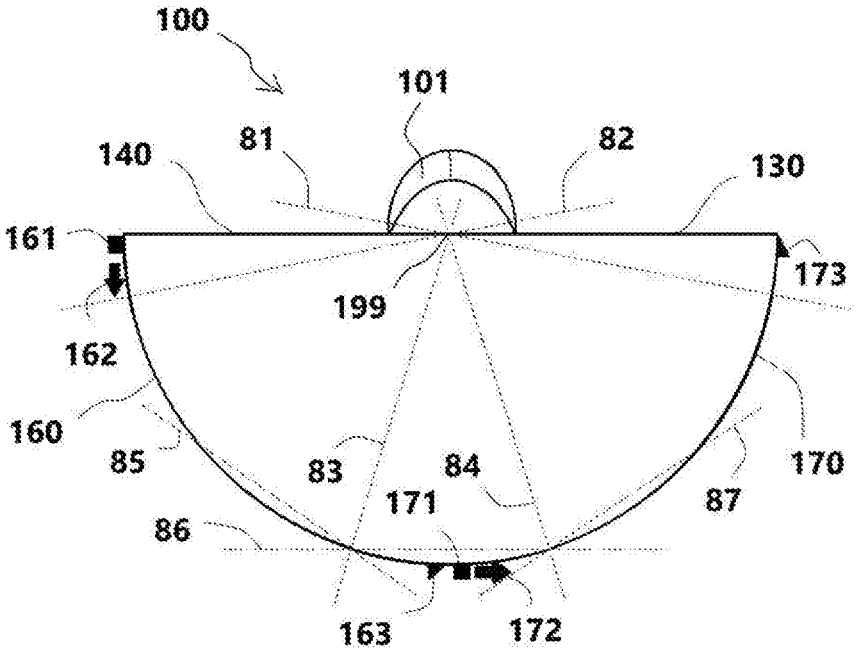
FIG. 62 illustrates a view of an outside surface of the semi-circled piece of FIG. 12 which can be used as an upper fabric in the alternative extension embodiment of the below FIGS. 63 and 64 according to embodiments of the present inventions.
Figure 63:
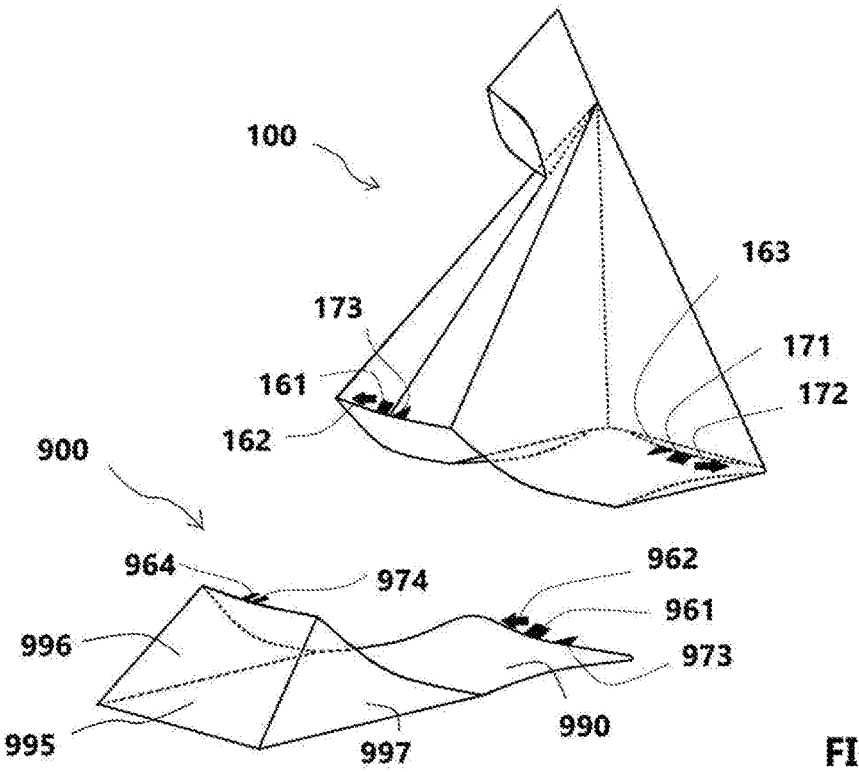
FIGS. 63 and 64 respectively illustrate detached and attached perspective views of the alternative extension embodiment according to embodiments of the present inventions.
Figure 64:
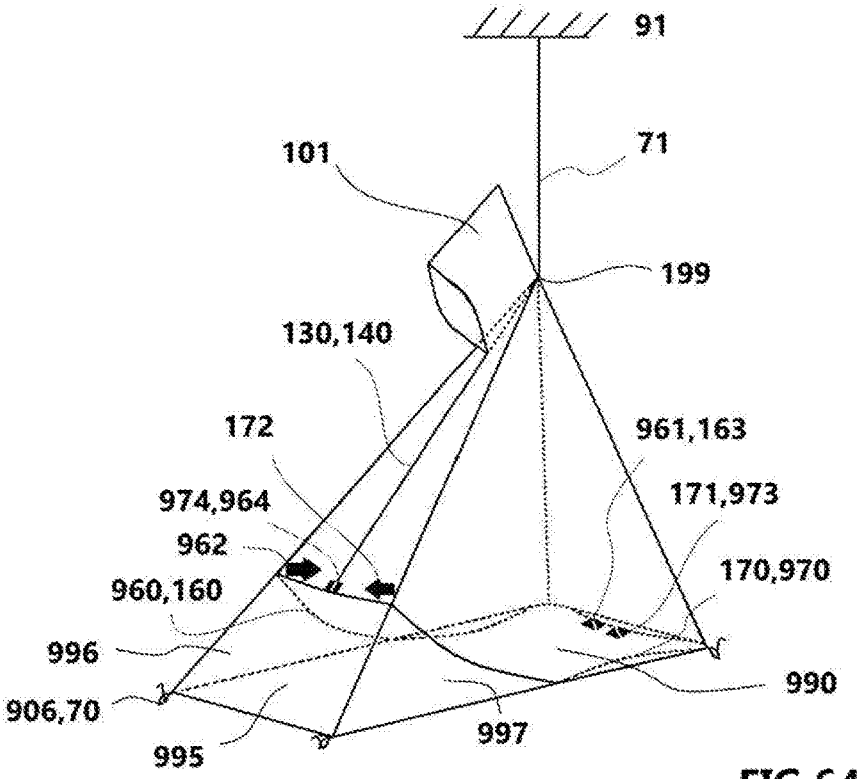

FIG. 61 illustrates a top view of an alternative extension embodiment for a bottom water-proof fabric. FIG. 62 illustrates a view of an outside surface of the semi-circled piece of FIG. 12 which can be used as an upper fabric in this alternative extension embodiment of the below FIGS. 63 and 64. FIGS. 63 and 64 respectively illustrate detached and attached perspective views of this alternative extension embodiment.

Although it is possible a 6' tall person to fit in the cape shelter on FIG. 49, most people would prefer to expand it with additional extension 900. The extension 900 could be a flat panel or a three dimensional, bag or flip-flop shaped panel, seen in perspective on FIG. 61. Nevertheless the shape, it has zippers 960 and 970 at its perimeter. These zippers could be the two halves of an open-end type zipper with box 961, pin 973, slider 962, and ends with stops 974 and 964.

Alternatively, single-tape type zipper where 964 is replaced with a pin and 974 is replaced with box and slider, in a manner similar to the one used for the more complicated shelters described before. Single-tape type zippers, compared to the open-end type zippers offer the advantage of extra doors and ventilation openings, which are more important when constructing shelters for more than one person.

As seen on FIG. 62, a top view of the bottom fabric 100, which is to be used on top for this particular shelter, at lines 81-87 the bottom fabric 100 is folded to take a three dimensional, pyramidal shape, seen in exploded view on FIG. 63. The enclosed compartment is constructed by inserting pin 163 into box 961 through slider 962, and pin 973 into box 171 through slider 172. The two sliders 172 and 962 then close into direction of points 974 and 964—FIG. 64.

The pyramidal structure is then secured with a rope 71 to a high point 91 and four stacks 70 inserted into the ground through loops 906. These loops 906 are situated at 900's four corners. They are double, one on each side of 900's zippers—FIG. 61, thus allowing 900 and 100 to be able to connect also when both are turned inside out.

In a similar manner, variations of 900 could be designed which are able to connect to a circled bottom fabric 200 or other rainwear. These panels always have zippers at its perimeter which mate by meshing with zippers at the rainwear perimeter.

The perimeter of the upper fabric is a semi-circle in the illustrated embodiment of FIGS. 61-64. A hood is located near a center of the substantially straight edge.

Trapezoid-shaped wall panel 995 and triangularly-shaped side panels 996 and 997 extend the length for a long legged individual to comfortably sleep on floor 990 of the bottom fabric of the tent. The bottom water-proof fabric comprises a trapezoid-shaped wall panel 995 attached at a bottom thereof to one end of a floor 990 of the bottom fabric of the tent and further comprises a right triangularly-shaped side panel 996 and a left triangularly-shaped side panel 997, each right and left triangularly-shaped side panel attach at a bottom thereof to portions of sides at one end of the floor 990 of the bottom fabric of the tent. The one or more zipper tapes serially circumscribe the bottom perimeter of the bottom water-proof fabric at least a top of the trapezoid-shaped wall panel, one top side of each triangularly-shaped side panel, one end of the bottom fabric, and remaining of the portions of each side of the bottom fabric. The support at a central portion of a surface of the upper fabric comprises a rope 71 secured between a high point 91 such as a tree branch and on the upper fabric at a point 199 where the folds or seams come together or near the hood 101 or on the hood 101 itself.

Figure 65:
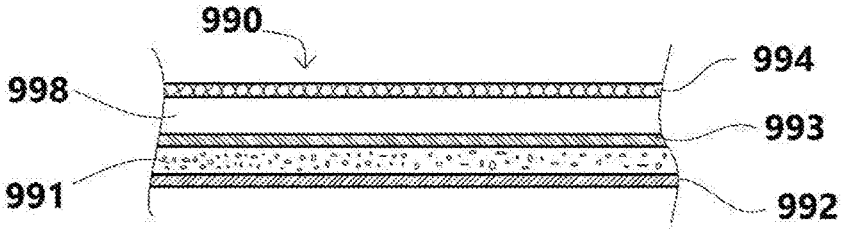
FIG. 65 illustrates a cross-section view of a multilayer floor for a bottom water-proof fabric according to embodiments of the present inventions.
Figure 66:
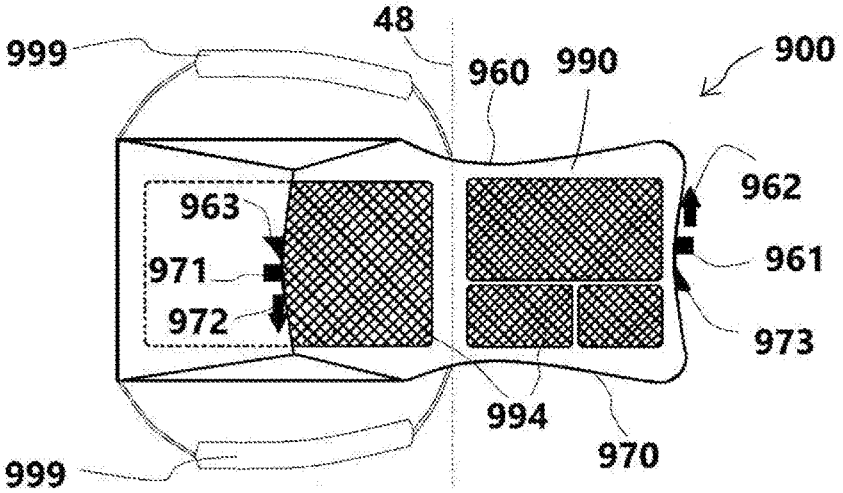
FIG. 66 illustrates a top view of an alternative construction for the extension embodiment of FIG. 61 for a bottom water-proof fabric according to embodiments of the present inventions.
Figure 67:
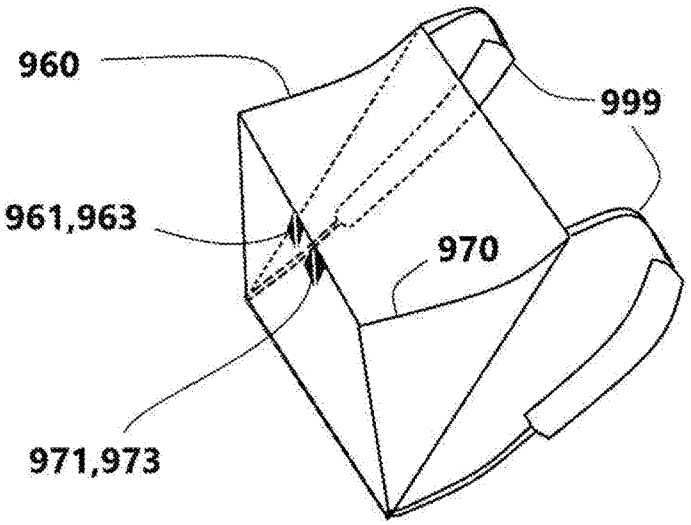
FIG. 67 illustrates a perspective view of a backpack formed by folding the bottom water-proof fabric according to embodiments of the present inventions.

FIG. 65 illustrates a cross-section view of a multilayer floor for a bottom water-proof fabric according to embodiments of the present inventions;

FIG. 66 illustrates a top view of an alternative construction for the extension embodiment of FIG. 61 for a bottom water-proof fabric according to embodiments of the present inventions; and FIG. 67 illustrates a perspective view of a backpack formed by folding the bottom water-proof fabric according to embodiments of the present inventions;

As demonstrated on FIGS. 65-67, constructing multilayer floor 990 for the extension 900, increases its functionality. Imbedding a sleeping pad layer 991, inflatable or made out of foam, and situating it between two layers of fabric 992 and 993, adds thermo-insulation as shown on the cross-section view on FIG. 65. Also, forming one or more empty storage compartments 998 by attaching on top of 990 a layer of stretchable mesh 994, is useful for adding extra thermo-insulation and for keeping clothes and other personal belongings, in organized and easy-to-reach manner.

Closing the zippers 960 and 970 and folding it at one or more lines 48 turns the extension 900 into a backpack. As shown on FIG. 66, the zippers 960 and 970 are single-tape type, and the enclosed compartment is formed by inserting the pins 963 and 973, through sliders 962 and 972 respectively, into boxes 961 and 971 respectively. Shoulder straps 999 are helpful when carrying the backpack shown in FIG. 67.

Figure 68:
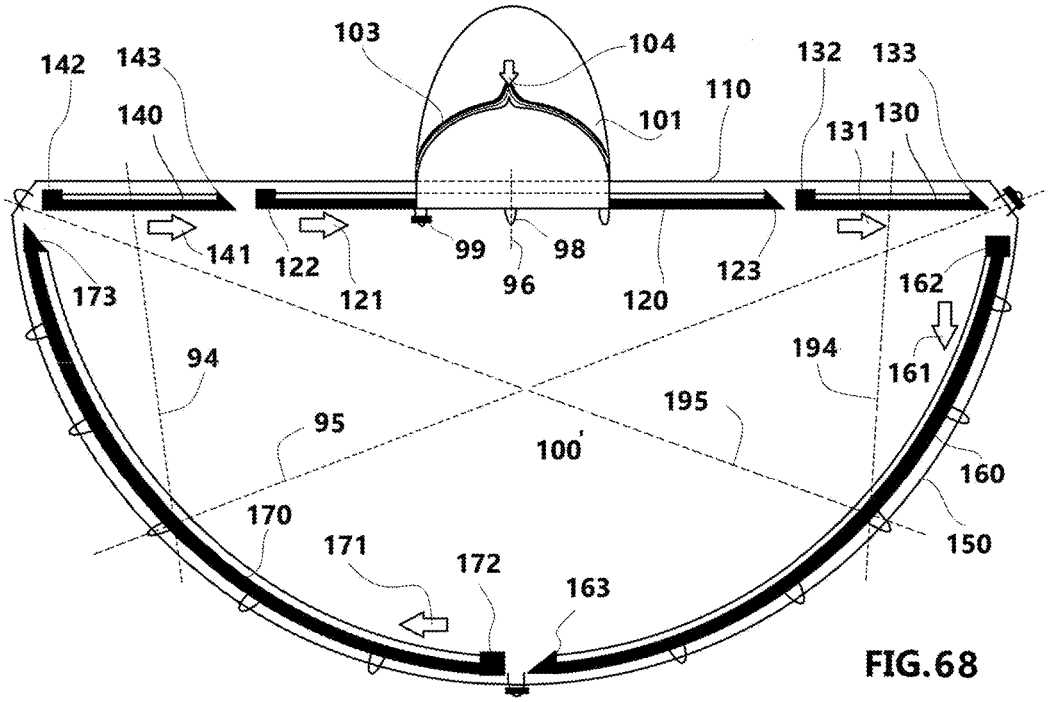
FIG. 68 illustrates perspective top view of the inside surface with zippers according to embodiments of the present inventions.

FIG. 68 demonstrates the preferred embodiment of the invention. It is a hooded piece of fabric with internal surface 100'. It has semi-elliptical or a semi-circular shape, with a perimeter essentially formed by one straight 110 and one rounded line 150. The said invention serves as a raincoat that could be turned into a shelter by asymmetrically folding and closing of the zippers at its peripheries. The hood 101, permanently or temporarily attached at the middle of perimeter 110, has a closed end zipper 103, with slider 104, at the hood face perimeter. The length of zipper 160 is equal to the combined length of zippers 120 and 130. The length of zipper 170 is equal to the combined length of zippers 120 and 140. Zippers 120, 130, 140, 160 and 170 are single-tape type zippers. A single-tape type zipper is a zipper, which has only one halve of tape with teeth, starts with a receptacle box, ends with an insertion pin, and has a slider in between. These zipper tapes are preferably all positioned in a series at the perimeter. While the zipper tapes can instead be positioned in series counterclockwise at the perimeter, clockwise is a preferred direction because the zipper pulls will be more easily operated by right-handed users. The loops 98, which could have toggles 99, are sewn to the zipper tapes or to the fabric. The loops 98 are situated at the increments of 15 degree at the perimeter 150, or around the hood at the perimeter 110.

The water-proof fabric has a perimeter consisting essentially of a straight section and a remaining section. The perimeter of the remaining section is circumscribed by first 170 and second 160 zipper tapes arranged in series. The perimeter of the straight section is circumscribed by third 140 and fourth 120 and fifth 130 zipper tapes. At least the third 140 and fifth 130 zipper tapes are arranged in series. The fourth zipper tape 120 is located centered around a center of the straight side with slider and receptacle box and insertion pin of the fourth zipper tape 120 symmetrically centered around the center of the straight side. The second zipper tape 160 extends along the remaining side to an end of the remaining side. The fifth zipper tape 130 extends along the straight side to the end of the straight side in an orientation of its slider and receptacle box or insertion pin to mesh at the corner with an orientation of another of slider and receptacle box or insertion pin of the second zipper tape 160. The first 170 and second 160 zipper tapes are of similar lengths. The sliders and receptacle boxes and insertion pins of the first 170, second 160, third 140, and fifth 130 zipper tapes face a same clockwise or counterclockwise direction along the perimeter of the water proof fabric. The third 140 and fourth 120 and fifth 130 zipper tapes are arranged in series. The sliders and receptacle boxes and insertion pins of the third 140 and fourth 120 and fifth 130 zipper tapes face the same direction along the straight section of the perimeter. The fourth 120 zipper tape is arranged in series in between the third 140 and fifth 130 zipper tapes. A base of hood 101 is coupled to the water-proof fabric near a center of the straight section of the water-proof fabric. The slider and receptacle box and insertion pin of the fourth zipper tape 120 face the same direction along the straight section of the perimeter. The third 140 and fifth 130 zipper tapes are positioned on the straight side of the water-proof fabric to form a cape when the third 140 zipper tape mates with the fifth zipper tape 130. The fourth zipper tape is located at a position on the straight side of the water-proof fabric to form a cape when the fourth zipper tape 120 mates with itself. The zipper tapes are located at positions on the water-proof fabric to form a bivy tent when mating at least as follows: the first zipper tape 170 folds and mates with itself, and the second zipper tape 160 mates with the fifth zipper tape 130. The zipper tapes are located at positions on the water-proof fabric to form a bivy tent when the second zipper tape 160 additionally mates with fourth zipper tape 120. The zipper tapes are located at positions on the water-proof fabric to form a bivy tent when the third zipper tape 140 additionally mates with itself. The remaining section is substantially semicircular.

Figure 69:
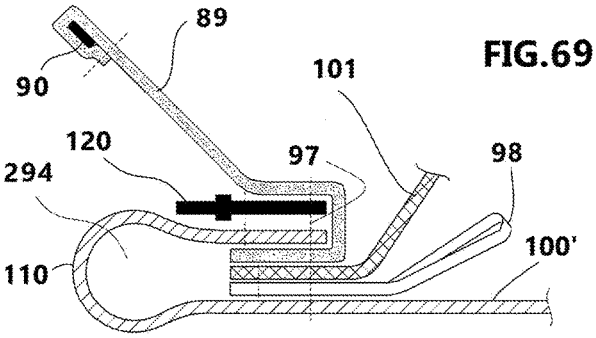
FIG. 69 demonstrates a detailed view of a cross section of a typical point of the straight portion of the perimeter according to embodiments of the present inventions.

FIG. 69 is a detailed view of a cross section at the middle point of perimeter 110, where it is crossed by line 96, but it also represents the perimeter 110 in general. The fabric is folded toward its inner surface, forming a channel 294, which runs the whole length of perimeter 110 and which could be used for inserting tent poles. It also serves as a flap which covers the zippers 140, 120, 130 and prevent water from coming through. A loop 98 may also be present, and it may have a toggle. The hood 101 is also attached at, and around of, the middle of perimeter 110. A flap 89, omitted on FIG. 68 so that the zippers 120, 130, and 140 could be visible, runs the whole length of perimeter 110. The flap 89 has edge which is formed by sewing to the fabric of a core 90. This core is made out of plastic or other material which would make the edge flexible but stiffer than if it was the fabric only.

Thus, the zippers 120, 130 and 140, are covered on one side by flap formed by channel 294, and on the other side by flap 89 with core 90. All elements are stitched together by seams 97.

Alternatively, the hood 101 could be attached under zipper 120 or outside, beneath the flap with channel 294.

Figure 70:
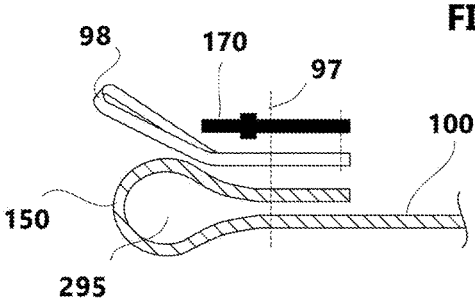
FIG. 70 demonstrates a detailed view of a cross section of a typical point of the semi-circular portion of the perimeter according to embodiments of the present inventions.

FIG. 70 is a detailed view of a cross section at the perimeter 150 at the point where it is crossed by line 95, but it also represents the perimeter 150 in general. The fabric is folded toward its inner surface 100', forming a channel 295, which runs the whole length of perimeter 150 and which could be used for inserting tent poles. It also serves as a flap and its purpose is to cover the zippers 160 and 170 and prevent water from coming through. A loop 98 may also be present, and it may have a toggle. All elements are stitched together by seams 97. Alternatively, besides channel 295, which covers zippers 160 and 170 outside on perimeter 150, a flap could also be sewn to cover the zippers on the inside. Thus channels 294 and 295 are formed on one side of the zipper tapes at all the fabric perimeters 110 and 150.

Figure 71:
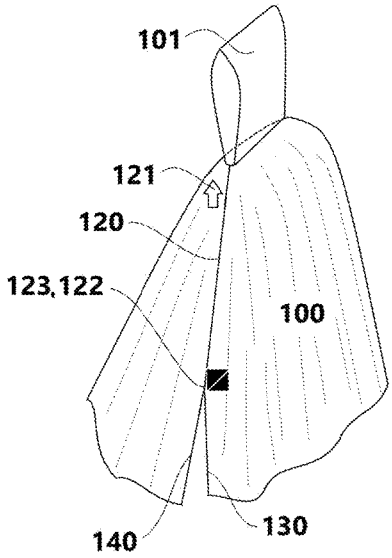
FIG. 71 illustrates a side view of a cape according to embodiments of the present inventions.

FIG. 71 is a view in perspective of a cloak type raincoat garment, as it would be worn by a user. It is formed by closing zipper 120 to itself, then by inserting pin 123 into box 122, trough slider 121 and closing the slider 121 into direction of the middle of zipper 120. Zipper 130 could also be connected and closed to zipper 140, or both could be left unconnected.

Figure 72:
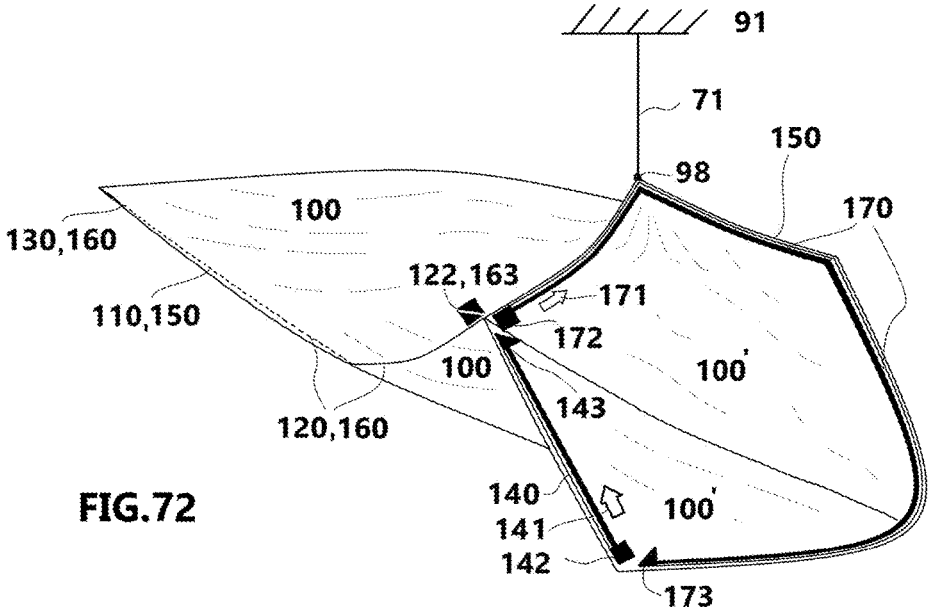
FIG. 72 illustrates a view in perspective of a partially closed bivy shelter suspended with a rope from a high point according to embodiments of the present inventions.

FIG. 72 is a view in perspective of a partially closed bivy type of shelter, which is hanged on a rope 71, from a high point 91 on one end, and a loop 98 at the perimeter 150 at the other end. The shelter is formed by asymmetrically folding the fabric at line 95 on FIG. 68, inserting pin 163 into box 122 through slider 121, inserting pin 133 into box 162 through slider 161 and closing sliders 121 and 161 against each other.

Figure 73:
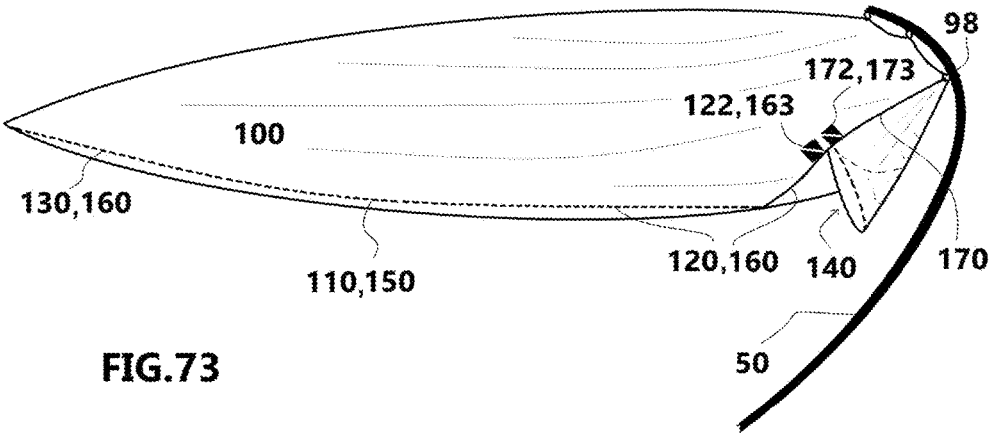
FIG. 73 demonstrates a slightly off top view in perspective of the next stage of the bivy shelter, but this time supported with a tent pole, according to embodiments of the present inventions.

FIG. 73 is a slightly off top view of the next stage of the shelter formation. This time, however, zipper 170 is also closed, but to itself. This is done by inserting pin 173 into box 172 through slider 171 and closing slider 171 into direction of the middle of zipper 170. Alternatively, instead of hanging from a high point, the shelter could be supported by a tent pole 50. Zipper 140 could be left open for ventilation.

Figure 74:
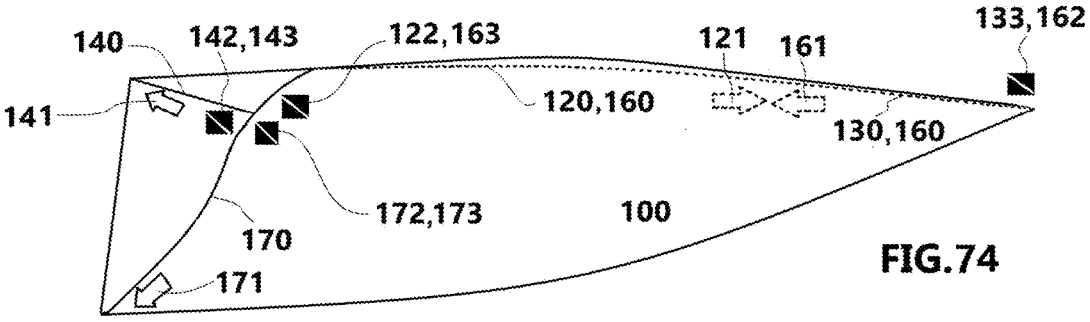
FIG. 74 demonstrates a top view of the fully closed bivy shelter, according to embodiments of the present inventions.

FIG. 74 is a top view of the same shelter, but this time, zipper 140 is also closed to itself by inserting pin 143 into box 142 through slider 141 and closing slider 141 into direction of the middle of zipper 140. The newly formed enclosed compartment completely envelopes the user's slipping bag. Alternatively, instead of hanging from a high point or using a tent pole, the shelter could be left unsupported.

In this preferred embodiment the length of zipper 120 is 68 inches while the lengths of zippers 130 and 140 are 24.5 inches each. The total length of the combination of zipper 120 and 130, including space of 0.5 inch between them, is the same as the length of zipper 160—93 inches. The total length of the combination of zipper 120 and 140, including space of 0.5 inch between them, is the same as the length of zipper 170—93 inches.

Alternatively, this shelter could be formed by folding the fabric at lines 194 and 195 on FIG. 68.

Figure 78:
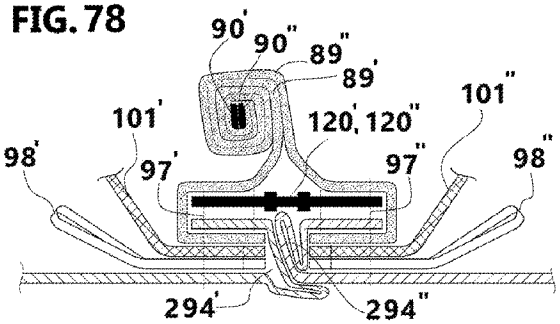
FIGS. 77-78 represent cross section diagrams of example of meeting points of the two meeting peripheries, before and after the connection is established, according to embodiments of the present inventions.
Figure 79:
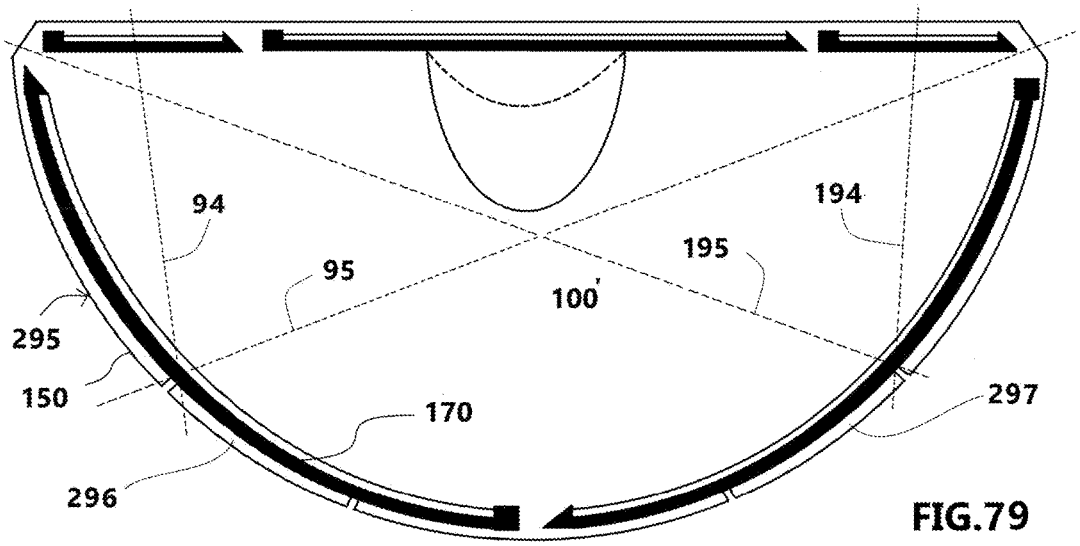
FIG. 79 illustrates a variation of the preferred embodiment in which the channel, which runs the entire semi-circular perimeter, is split into at least three sectors, according to embodiments of the present inventions.

This rainwear could be used for construction of other types of shelters too—FIG. 79. For that purpose two rain capes are connected together as demonstrated on FIG. 75-78.

While the embodiments of FIGS. 68-74 illustrate zipper tapes on the same side of the water proof fabric, some or all of the zipper tapes can instead be positioned on edges of the water proof fabric.

Figure 75:
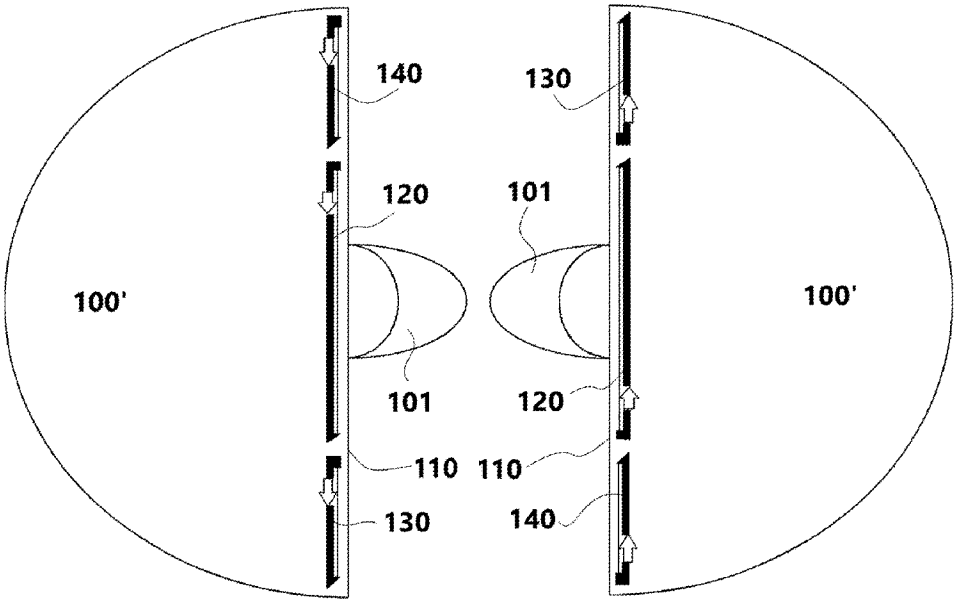
FIG. 75 illustrates a top view of three zippers of two copies according to embodiments of the present inventions.

FIG. 75 is a top view of the connection. First, the two capes are aligned together. Then zipper 130 of the first one is connected to zipper 140 of the second one, zipper 120 of the first one is connected to zipper 120 of the second one and zipper 140 of the first one is connected to zipper 130 of the second one.

Figure 76:
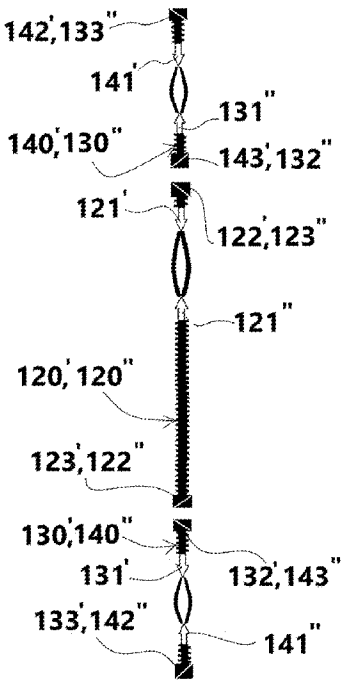
FIG. 76 illustrates an end view from top of the three zippers with their sliders pulled and the zippers nearly closed when connecting the two semi-circled bottom fabrics according to embodiments of the present inventions.

FIG. 76 is a top view of the connection in detail. Pin 133' is inserted into box 142" through slider 141". Pin 143" is inserted into box 132' through slider 131'. The two sliders, 141" and 131', form the connection of zippers 130' and 140" by closing against each other.

Pin 123' is inserted into box 122" through slider 121". Pin 123" is inserted into box 122' through slider 121'. The two sliders, 121" and 121', form the connection of zippers 120' and 120" by closing against each other.

Pin 143' is inserted into box 132" through slider 131". Pin 133" is inserted into box 142' through slider 141'. The two sliders, 131" and 141', form the connection of zippers 140' and 130" by closing against each other.

Figure 77:
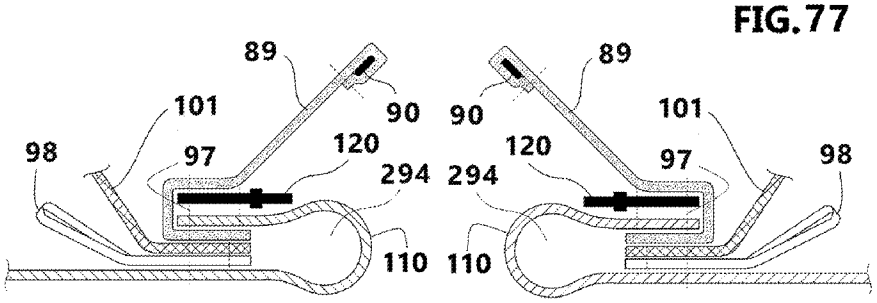

FIG. 77 and FIG. 78 represent cross section of the connection in detail. The cores 90' and 90" are brought together and the flaps 89' and 89" are rolled together to provide water resistance of the connection 120'-120".

FIG. 79 represents a variation of the preferred embodiment in which the channel 295, which runs the entire semi-circular perimeter 150, is split into at least three sectors. When constructing the bivy shelter and folding of the fabric is done at lines 94 and 95, sector 296 could be used for inserting tent pole support 50—FIG. 80. Alternatively, sector 297, if present, is being used, when the fabric is folded at lines 194 and 195.

Figure 80:
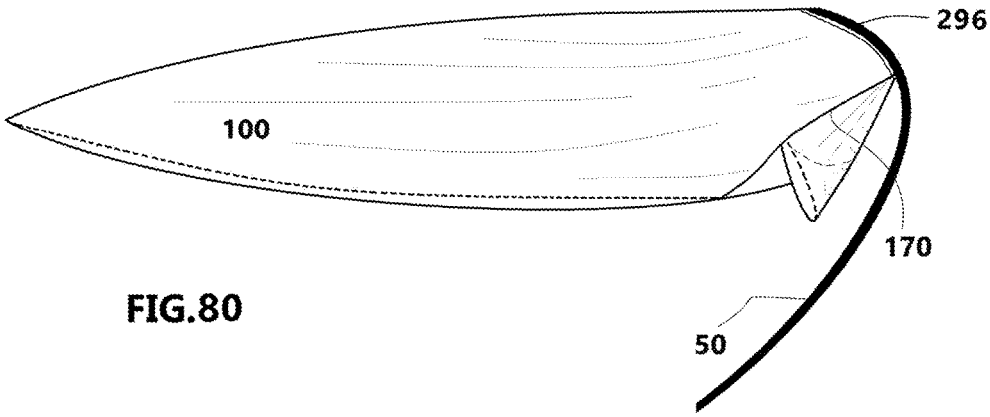
FIG. 80 demonstrates a slightly off top view in perspective of the tent pole supported bivy shelter, which uses a sector of the channel formed at the semi-circular perimeter, according to embodiments of the present inventions.

FIG. 80 demonstrates a slightly off top view in perspective of the tent pole supported bivy shelter, which uses a sector of the channel formed at the semi-circular perimeter, according to embodiments of the present inventions.

Figure 81:
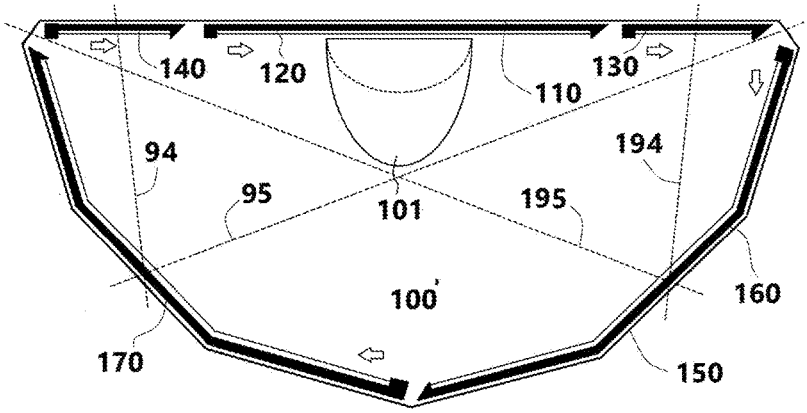
FIG. 81 represents an alternative embodiment in which, instead a piece of fabric with semi-circular perimeter, an angled one is used, according to embodiments of the present inventions.

FIG. 81 represents an alternative embodiment in which, instead a piece of fabric with semi-circular perimeter, an angled one is used. Sewing zippers in straight lines makes angled shaped embodiments easier to manufacture, but closing zippers at angles makes such embodiments harder to use. Rainwear and shelter are formed as described before, however, the fewer the angles, the less feasible becomes the option of imbedding channels 295 at the perimeter 150 and running tent poles through them. These factors make angled embodiments inferior when compared to the other embodiments.

Figure 82:
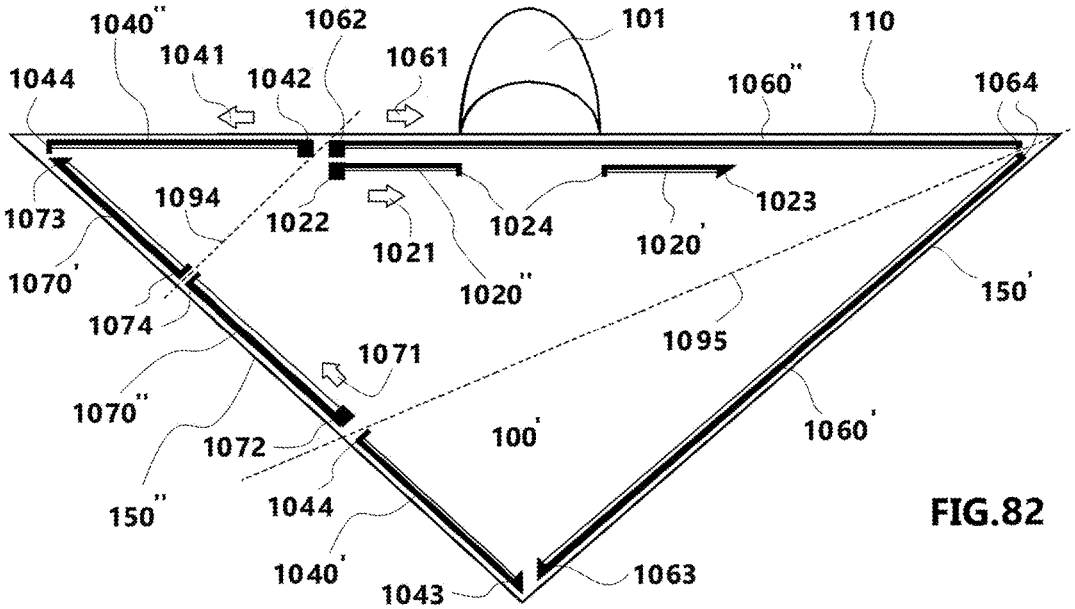
FIG. 82 demonstrates triangularly shaped embodiment with regular, instead of single-string, zippers according to embodiments of the present inventions.

The embodiment on FIG. 82, besides an alternative shape, demonstrates the use of regular, open end type, zippers, instead of single-string ones. It also shows a different way of folding the fabric when wrapping the user's sleeping bag. Zipper 1060 has two halves, open end type zipper. One of these halves 1060' is situated at the perimeter 150', starts with a pin 1063 and ends with a zipper stop 1064. The other halve 1060" is at the perimeter 110, starts with a box 1062, ends with a zipper stop 1064 and has slider 1061 in between. Zipper 1040 has two halves, open end type zipper. One of these halves 1040' is situated at the perimeter 150", starts with a pin 1043 and ends with a zipper stop 1044. The other halve 1040" is at the perimeter 110, starts with a box 1042, ends with a zipper stop 1044 and has slider 1041 in between. Zipper 1070 is a two halves regular zipper. One of these halves 1070' is situated at the perimeter 150, starts with a pin 1073 and ends with a zipper stop 1074. The other halve 1070" is also at the perimeter 150, starts with a box 1072, ends with a zipper stop 1074 and has slider 1071 in between. Zipper 1020 is a two halves, open end type zipper. One of these halves 1020' is situated at the perimeter 110, starts with a pin 1023 and ends with a zipper stop 1024. The other halve 1020" is also at the perimeter 110, starts with a box 1022, ends with a zipper stop 1024 and has slider 1021 in between.

Figure 83:
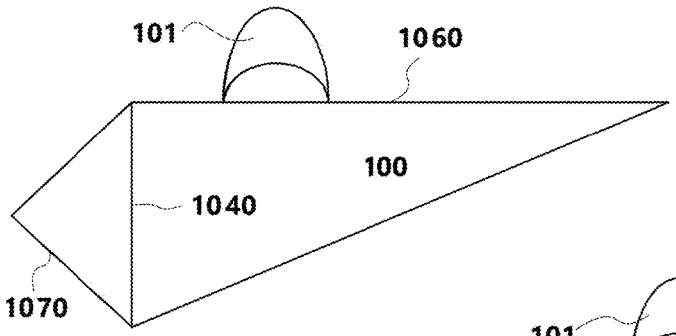
FIG. 83 demonstrates a top view of alternatively folded and fully closed bivy shelter, according to embodiments of the present inventions.
Figure 84:
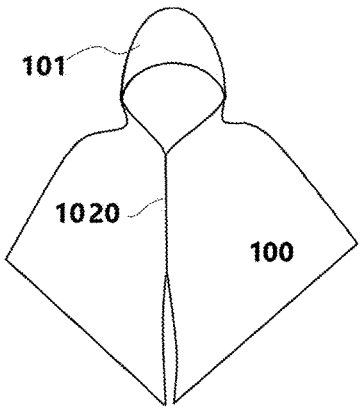
FIG. 84 illustrates a side view of a cape according to embodiments of the present inventions.

FIG. 83 demonstrates a top view of alternatively folded and fully closed bivy shelter, according to embodiments of the present inventions. To form a tent 1060' and 1060", the two halves of zipper 1060, are connected in FIG. 83. This is done by inserting pin 1063 into box 1062, through slider 1061, and closing the slide 1061 into direction of zipper stops 1064. Then 1070' and 1070", the two halves of zipper 1070, are connected. This is done by inserting pin 1073 into box 1072, through slider 1071, and closing the slide 1071 into direction of zipper stops 1074. And finally, 1040' and 1040", the two halves of zipper 1040, are connected. This is done by inserting pin 1043 into box 1042, through slider 1041, and closing the slide 1041 into direction of zipper stops 1044.

To form a rainwear garment, 1020' and 1020", the two halves of zipper 1020, are connected—FIG. 85. This is done by inserting pin 1023 into box 1022, through slider 1021, and closing the slide 1021 into direction of zipper stops 1024.

Provided that the lightest fabric is chosen, the weight of a tent depends not only on how much fabric is used, or its surface area, but also on the quantity and the weight of the fastening elements attached to the fabric. This embodiment saves weight on fabric but also adds additional zipper tapes. It decreases the available volume of the tent and decreases the functionality of the product, which makes this embodiment inferior, when compared to the preferred embodiment.

FIG. 85 illustrates in a table a summary of embodiments of the present inventions. In the illustrated table, the symbol "=" means "connects to" and the symbol "+" means "and."

Any letter designations such as (a) or (b) used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. An outdoor shelter system comprising a water-proof fabric with a perimeter consisting essentially of a straight section and a remaining section, the perimeter of the remaining section circumscribed by first and second zipper tapes arranged in series and the perimeter of the straight section circumscribed by third and fourth and fifth zipper tapes with at least the third and fifth zipper tapes arranged in series, wherein the fourth zipper tape is located centered around a center of the straight side with slider and receptacle box and insertion pin of the fourth zipper tape symmetrically centered around the center of the straight side.

2. An outdoor shelter system according to claim 1,
wherein the second zipper tape extends along the remaining side to an end of the remaining side; and
wherein the fifth zipper tape extends along the straight side to the end of the straight side in an orientation of its slider and receptacle box or insertion pin to mesh at the corner with an orientation of another of slider and receptacle box or insertion pin of the second zipper tape.

3. An outdoor shelter system according to claim 2, wherein the first and second zipper tapes are of similar lengths.

4. An outdoor shelter system according to claim 2, wherein the sliders and receptacle boxes and insertion pins of the first, second, third, and fifth zipper tapes face a same clockwise or counterclockwise direction along the perimeter of the water proof fabric.

5. An outdoor shelter system according to claim 4,
wherein the third and fourth and fifth zipper tapes are arranged in series; and
wherein sliders and receptacle boxes and insertion pins of the third and fourth and fifth zipper tapes face the same direction along the straight section of the perimeter.

6. An outdoor shelter system according to claim 5, wherein the fourth zipper tape is arranged in series in between the third and fifth zipper tapes.

7. An outdoor shelter system according to claim 6, further comprising a hood, wherein a base of the hood is coupled to the water-proof fabric near a center of the straight section of the water-proof fabric.

8. An outdoor shelter system according to claim 7, wherein the slider and receptacle box and insertion pin of the fourth zipper tape face the same direction along the straight section of the perimeter.

9. An outdoor shelter system according to claim 2, wherein the third and fifth zipper tapes are positioned on the straight side of the water-proof fabric to form a cape when the third zipper tape mates with the fifth zipper tape.

10. An outdoor shelter system according to claim 2, wherein fourth zipper tape is located at a position on the straight side of the water-proof fabric to form a cape when the fourth zipper tape mates with itself.

11. An outdoor shelter system according to claim 10, wherein the zipper tapes are located at positions on the water-proof fabric to form a bivy tent when mating at least as follows: the first zipper tape folds and mates with itself, and the second zipper tape mates with the fifth zipper tape.

12. An outdoor shelter system according to claim 11, wherein the zipper tapes are located at positions on the water-proof fabric to form a bivy tent when the second zipper tape additionally mates with fourth zipper tape.

13. An outdoor shelter system according to claim 12, wherein the zipper tapes are located at positions on the water-proof fabric to form a bivy tent when the third zipper tape additionally mates with itself.

14. An outdoor shelter system according to claim 1, wherein the remaining section is substantially semicircular.

15. An outdoor shelter system according to claim 14, further comprising a waterproof canopy fabric having zippers located thereon in positions that form an enclosed tent when meshing with at least the first and second and third and fifth zipper tapes of one of the waterproof fabric.

16. An outdoor shelter system according to claim 14, further comprising a waterproof canopy fabric having zippers located thereon in positions that form an enclosed tent when meshing with at least the first and second zipper tapes of each of a pair of the waterproof fabric and form a floor of the enclosed tent when at least the third and the fifth zipper tapes of each of the pair of the water proof fabric mesh with one another.

17. An outdoor shelter system according to claim 1, further comprising a hood, wherein a base of the hood is coupled to the water-proof fabric near a center of the straight section of the water-proof fabric.

18. An outdoor shelter system according to claim 1, further comprising loops attached along the perimeter of the water-proof fabric, at least some of the loops comprising toggles.

19. An outdoor shelter system according to claim 1, further comprising a channel formed along the perimeter of the water-proof fabric of a size to accommodate a tent pole.

20. An outdoor shelter system according to claim 1, further comprising a flap with a flexible core secured to the perimeter of the water-proof fabric.

* * * * *